US010058726B2

(12) United States Patent
Jones-Guinasso

(10) Patent No.: US 10,058,726 B2
(45) **Date of Patent: *Aug. 28, 2018**

(54) EXERCISE APPARATUS

(71) Applicant: Deanna L. Jones-Guinasso, Redding, CA (US)

(72) Inventor: Deanna L. Jones-Guinasso, Redding, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/614,473

(22) Filed: Jun. 5, 2017

(65) Prior Publication Data

US 2017/0319893 A1 Nov. 9, 2017

Related U.S. Application Data

(63) Continuation of application No. 15/212,172, filed on Jul. 15, 2016, now Pat. No. 9,669,251.

(Continued)

(51) Int. Cl.
*A63B 23/035* (2006.01)
*A63B 23/04* (2006.01)

(Continued)

(52) U.S. Cl.
CPC .... *A63B 21/0624* (2015.10); *A63B 21/00181* (2013.01); *A63B 21/068* (2013.01); *A63B 21/0626* (2015.10); *A63B 21/154* (2013.01); *A63B 21/4035* (2015.10); *A63B 21/4045* (2015.10); *A63B 23/0405* (2013.01);

(Continued)

(58) Field of Classification Search
CPC ..... A63B 21/0628; A63B 21/4047; A63B 21/4035; A63B 2208/0233; A63B 2225/09; A63B 23/12; A63B 21/0615; A63B 23/03541; A63B 23/1254; A63B 21/159; A63B 23/0494; A63B 21/063; A63B 2208/0204; A63B 2225/093; A63B 23/0211; A63B 23/0405; A63B 23/0222; A63B 23/035; A63B 23/03516; A63B 23/03533; A63B 23/04; A63B 23/0482;

(Continued)

(56) References Cited

U.S. PATENT DOCUMENTS 3,708,167 A 1/1973 Potgieter
4,240,627 A 12/1980 Brentham (Continued)

FOREIGN PATENT DOCUMENTS

DE 10237243 A1 2/2004

OTHER PUBLICATIONS

Examiner initiated interview summary dated Jan. 31, 2017 for U.S. Appl. No. 15/212,172, filed Jul. 15, 2016, 1 page.

(Continued)

*Primary Examiner* — Andrew S Lo
(74) *Attorney, Agent, or Firm* — Intellectual Innovations Legal Advisors

(57) ABSTRACT

An exercise apparatus including a base, an arm assembly having first and second arms for engaging the outside of the legs of a human and a coupling assembly for securing the arm assembly to the base. The coupling assembly can include a pivot assembly for permitting the first and second arms to move between a contracted position and an extended position as the legs are pivoted away from each other. The first and second arms can be urged towards the contracted position. Methods for operating the exercise apparatus and other apparatus are provided.

5 Claims, 23 Drawing Sheets

Related U.S. Application Data

(60) Provisional application No. 62/231,812, filed on Jul. 15, 2015.

(51) Int. Cl.

| | |
|---|---|
| ***A63B 21/062*** | (2006.01) |
| ***A63B 21/00*** | (2006.01) |
| ***A63B 21/068*** | (2006.01) |
| *A63B 21/02* | (2006.01) |
| *A63B 21/008* | (2006.01) |
| *A63B 69/00* | (2006.01) |

(52) U.S. Cl.
CPC .... *A63B 69/0057* (2013.01); *A63B 21/00069* (2013.01); *A63B 21/0087* (2013.01); *A63B 21/023* (2013.01); *A63B 21/0628* (2015.10); *A63B 21/4047* (2015.10); *A63B 23/03525* (2013.01); *A63B 23/0482* (2013.01); *A63B 23/0494* (2013.01); *A63B 2023/0411* (2013.01); *A63B 2069/0062* (2013.01); *A63B 2225/10* (2013.01)

(58) Field of Classification Search
CPC .... A63B 23/0488; A63B 21/062; A63B 21/00
USPC ..... 482/100
See application file for complete search history.

(56) References Cited

U.S. PATENT DOCUMENTS

| | | | |
|---|---|---|---|
| 5,201,694 | A | 4/1993 | Zappel |
| 5,277,681 | A | 1/1994 | Holt |
| 5,393,286 | A | 2/1995 | Cheng |
| 5,518,477 | A | 5/1996 | Simonson |
| 5,518,482 | A | 5/1996 | Hsieh |
| 5,554,083 | A | 9/1996 | Chen |
| 5,616,110 | A | 4/1997 | Nascimento |
| 5,688,216 | A | 11/1997 | Mauriello |
| 6,090,022 | A | 7/2000 | Colecchi |
| 6,387,023 | B1 | 5/2002 | Liga, Jr. |
| 6,565,494 | B1 | 5/2003 | Chen |
| 6,632,160 | B2 | 10/2003 | Lafond et al. |
| D526,032 | S | 8/2006 | Wu |
| 7,160,234 | B2 | 1/2007 | Dise |
| 7,396,319 | B1 | 7/2008 | Ellis |
| 7,556,593 | B2 | 7/2009 | Sato |
| 7,575,538 | B1 | 8/2009 | Clark |
| 7,662,075 | B2 | 2/2010 | Isom |
| 7,988,603 | B2 | 8/2011 | Webber et al. |
| 8,057,368 | B1 | 11/2011 | Lyszczarz |
| 8,267,843 | B2 | 9/2012 | Dellino |
| 8,992,393 | B2 | 3/2015 | Reyes |
| 2004/0097335 | A1 | 5/2004 | Chu |
| 2005/0079956 | A1 | 4/2005 | Bruno |
| 2005/0148445 | A1 | 7/2005 | Carle |
| 2005/0227826 | A1 | 10/2005 | Oga |
| 2006/0100069 | A1 | 5/2006 | Dibble et al. |
| 2006/0247097 | A1 | 11/2006 | La Voie et al. |
| 2008/0051267 | A1 | 2/2008 | Ish et al. |
| 2008/0051268 | A1 | 2/2008 | Ish et al. |
| 2008/0051269 | A1 | 2/2008 | Lines |
| 2009/0098986 | A1 | 4/2009 | Quinn |
| 2009/0258761 | A1 | 10/2009 | Quinn |
| 2010/0248917 | A1 | 9/2010 | Reyes |
| 2011/0028280 | A1 | 2/2011 | Adams |
| 2012/0252639 | A1 | 10/2012 | Simonson |
| 2014/0315689 | A1 | 10/2014 | Vauquelin et al. |
| 2014/0364282 | A1 | 12/2014 | Moschel |
| 2015/0111708 | A1 | 4/2015 | Smith et al. |

OTHER PUBLICATIONS

Friden, J., et al., "Structural and Mechanical Basis of Exercise-induced Muscle Injury," Medicine and Science in Sports and Exercise, vol. 24 (5), pp. 521-530.

International Search Report for Application No. PCT/US2016/042681, dated Dec. 8, 2016, pp. 1-4.

Notice of Allowance dated Jan. 31, 2017 for U.S. Appl. No. 15/212,172, filed Jul. 15, 2016, pp. 1-13.

Response dated Feb. 13, 2017 for Notice of Allowance dated Jan. 31, 2017 for U.S. Appl. No. 15/212,172, filed Jul. 15, 2016, pp. 1-34.

Written Opinion for Application No. PCT/US2016/042681, dated Dec. 8, 2016, pp. 1-6.

EXERCISE APPARATUS

CROSS REFERENCE TO RELATED APPLICATION

This application is a U.S. nonprovisional continuation patent application of Ser. No. 15/212,172 filed Jul. 15, 2016, now U.S. Pat. No. 9,669,251, which claims priority to U.S. provisional patent application Ser. No. 62/231,812 filed Jul. 15, 2015, the entire content of each of which is incorporated herein by this reference.

FIELD OF THE INVENTION

The present invention relates to exercise apparatus and, more particularly, to an apparatus for exercising the lower body.

BACKGROUND OF THE INVENTION

Machines have been provided for exercising the lower body. For example, squat machines generally have the user place a weight on the user's shoulders. Other squat machines have the user hold barbells or dumbbells. Another machine for the lower body is the leg press, on which the user sits and pushes a plate with the user's feet. These machines typically use the gluteus maximus muscle of the user as a stabilizer.

What is needed is an apparatus for exercising the lower body that engages the gluteus maximus muscle of the user.

BRIEF DESCRIPTION OF THE DRAWINGS

The drawings described herein are for illustration purposes only and are not intended to limit the scope of the present disclosure in any way.

DETAILED DESCRIPTION OF THE INVENTION

Figure 1:
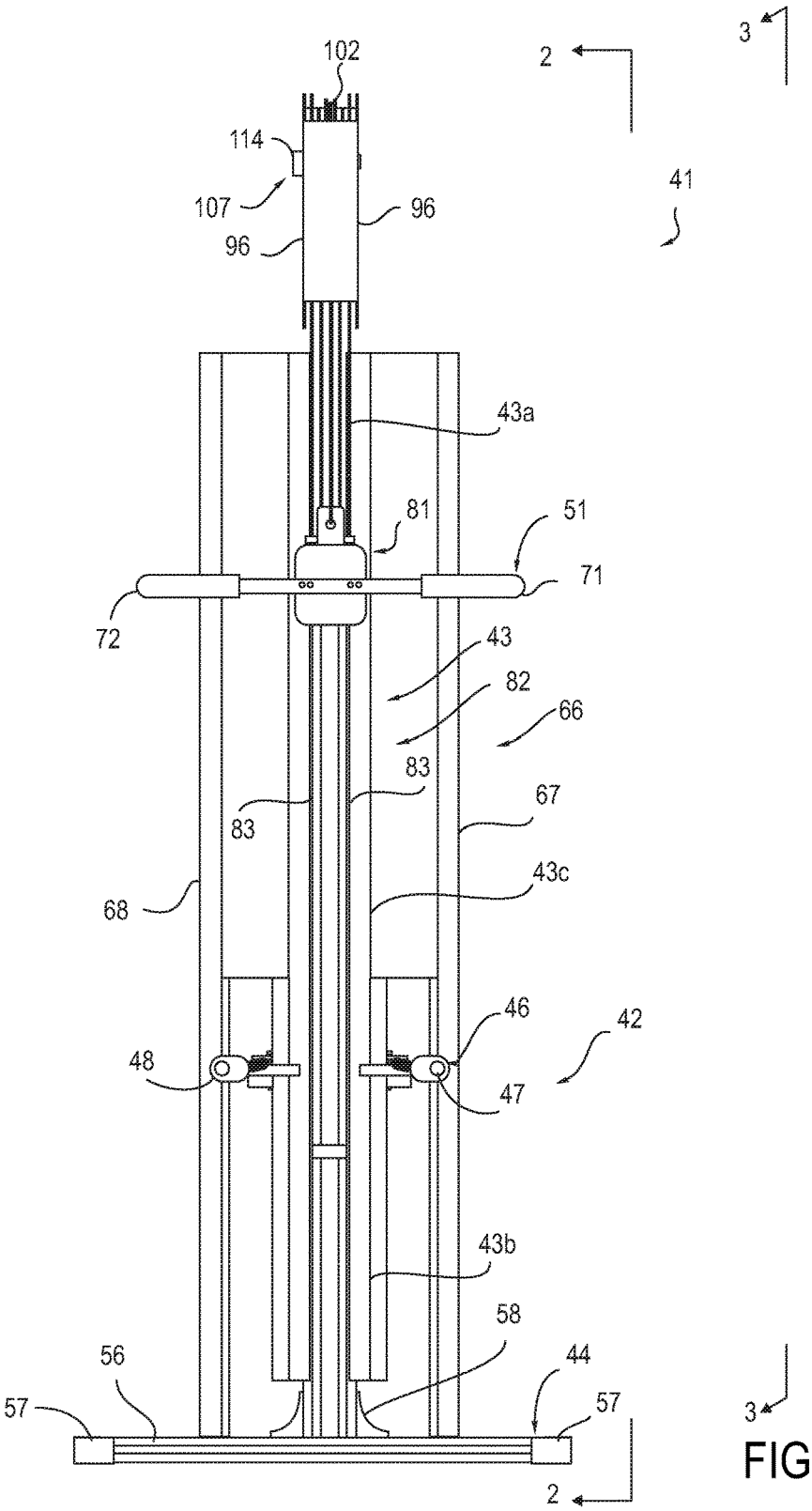
FIG. 1 is a front elevational view of one embodiment of an exercise apparatus of the present invention.
Figure 2:
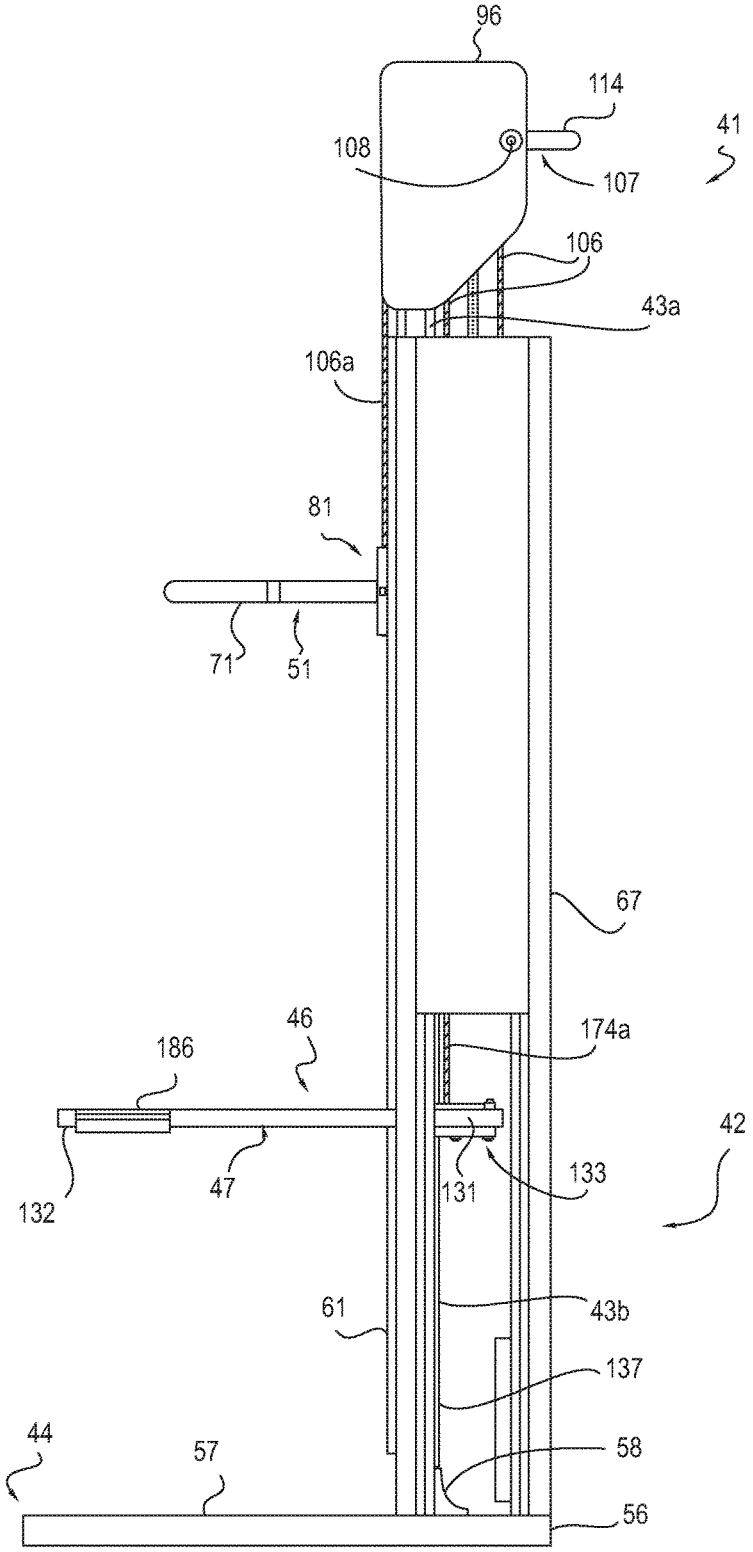
FIG. 2 is a side elevational view of the exercise apparatus of FIG. 1 taken along the line 2-2 of FIG. 1.
Figure 3:
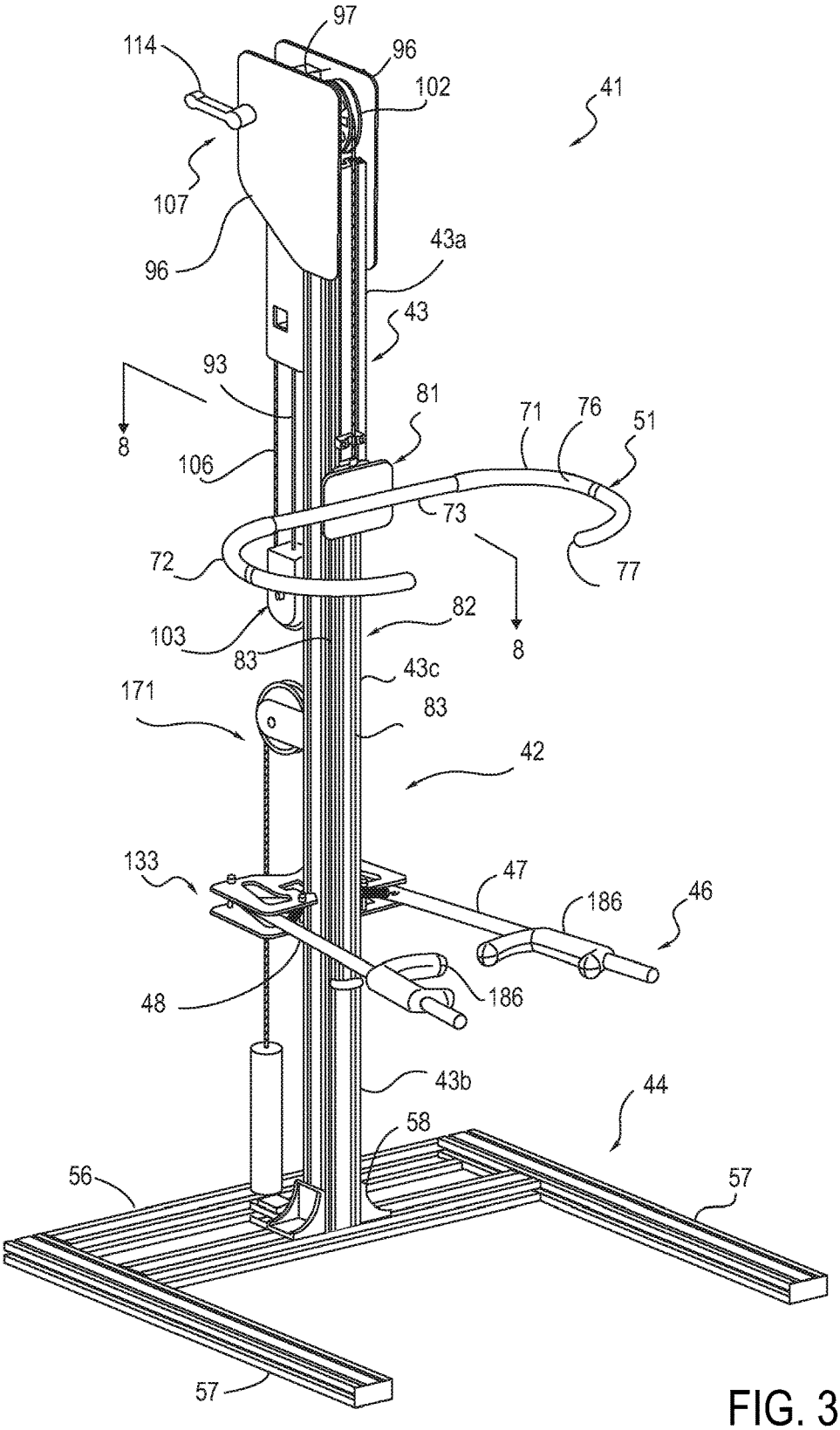
FIG. 3 is a perspective view of the exercise apparatus of FIG. 2 taken along the line 3-3 of FIG. 1.
Figure 4:
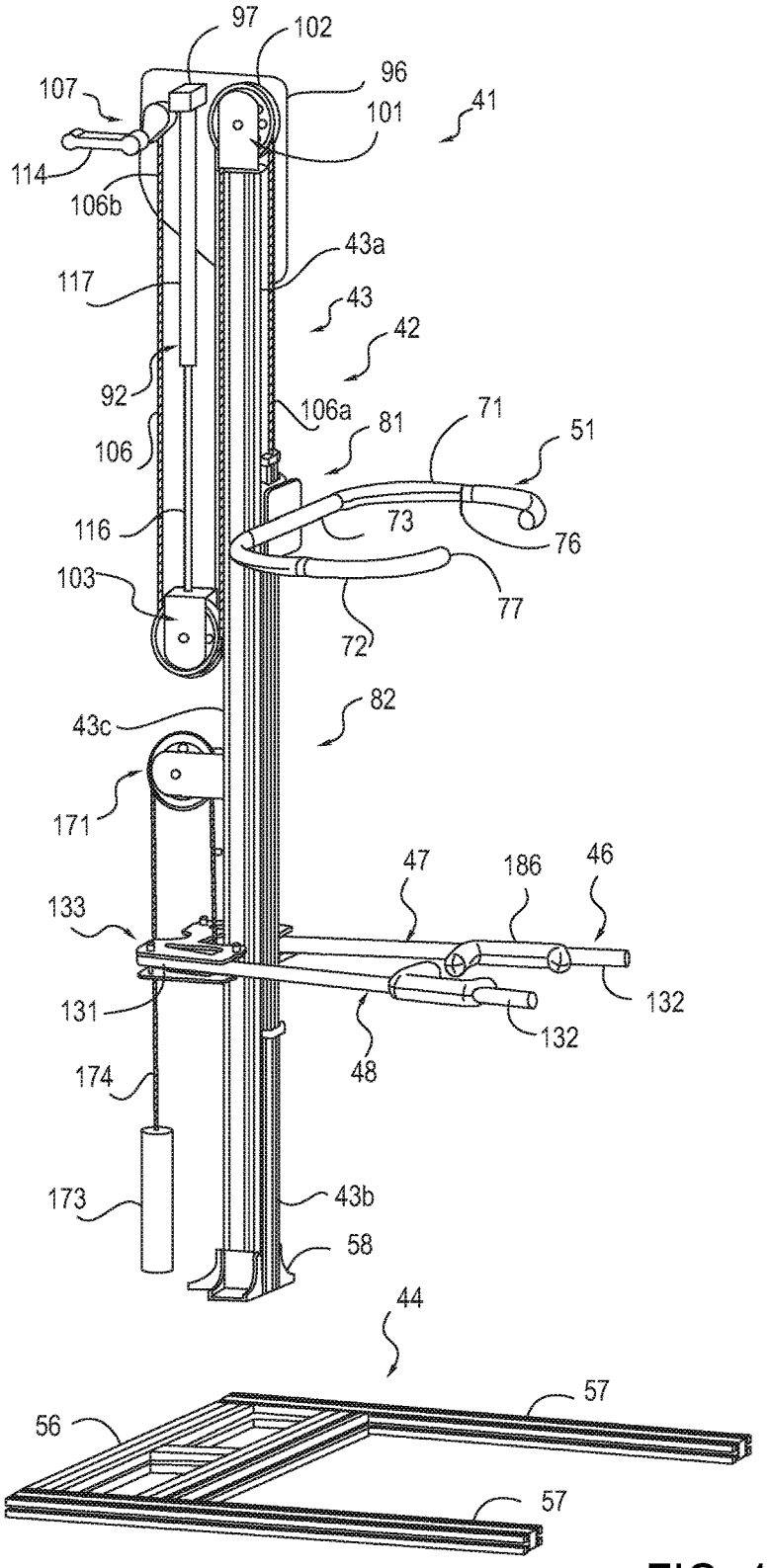
FIG. 4 is a partially exploded perspective view of a portion of the exercise apparatus of FIG. 1.
Figure 5:
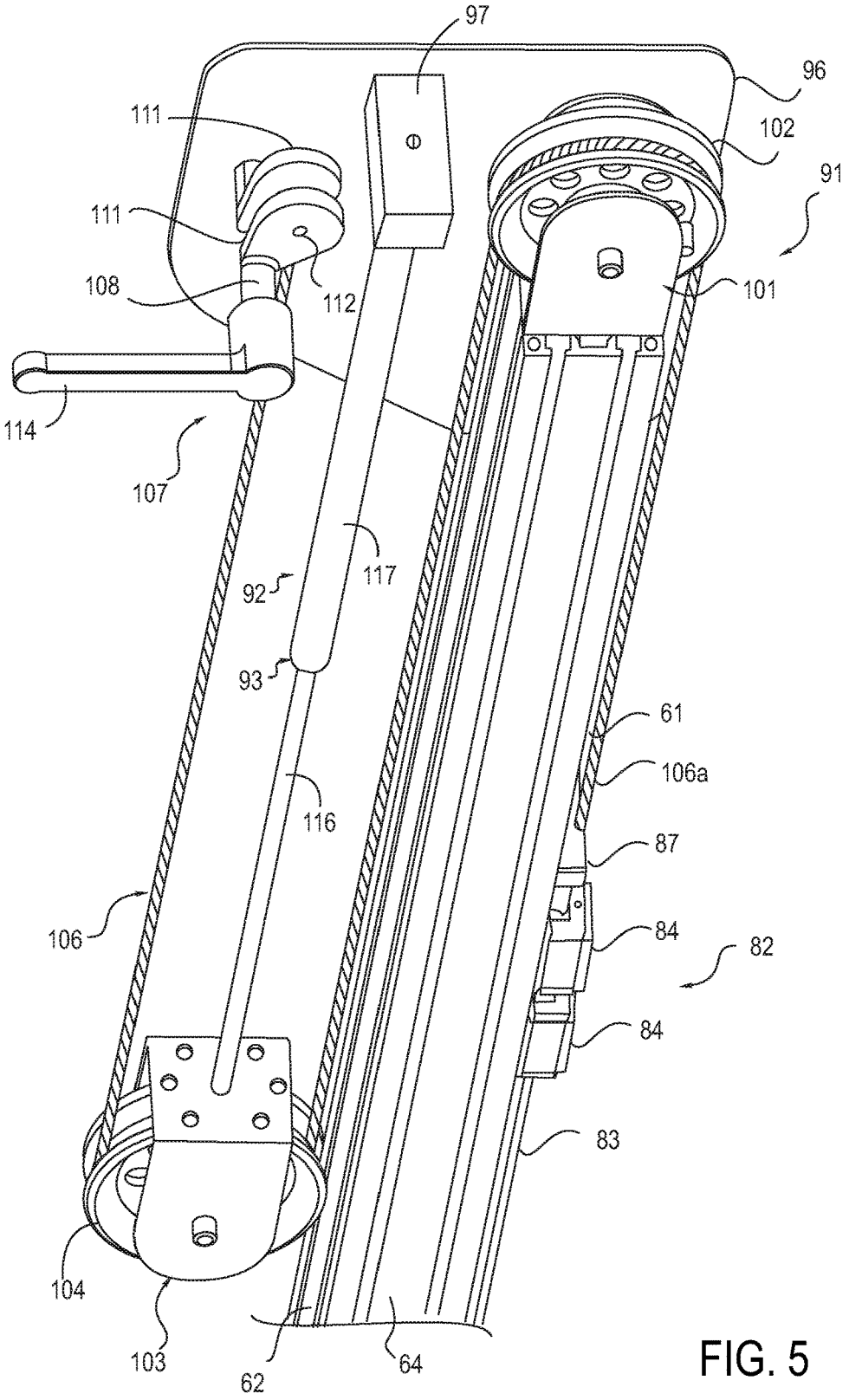
FIG. 5 is an exploded view of the upper portion of the exercise apparatus of FIG. 4 with the upper body support element removed.
Figure 6:
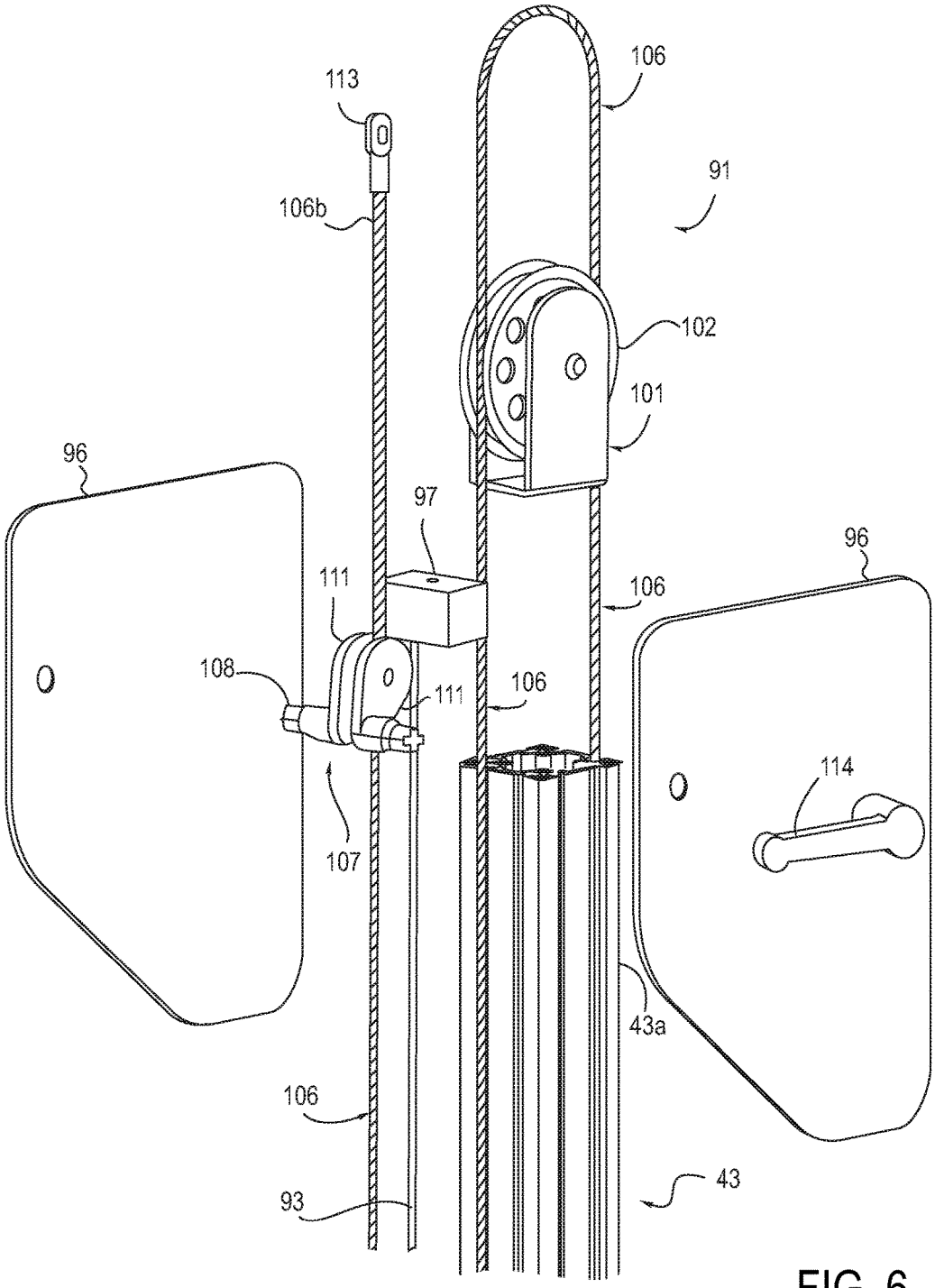
FIG. 6 is an exploded view of the upper end of the exercise apparatus of FIG. 1.
Figure 7:
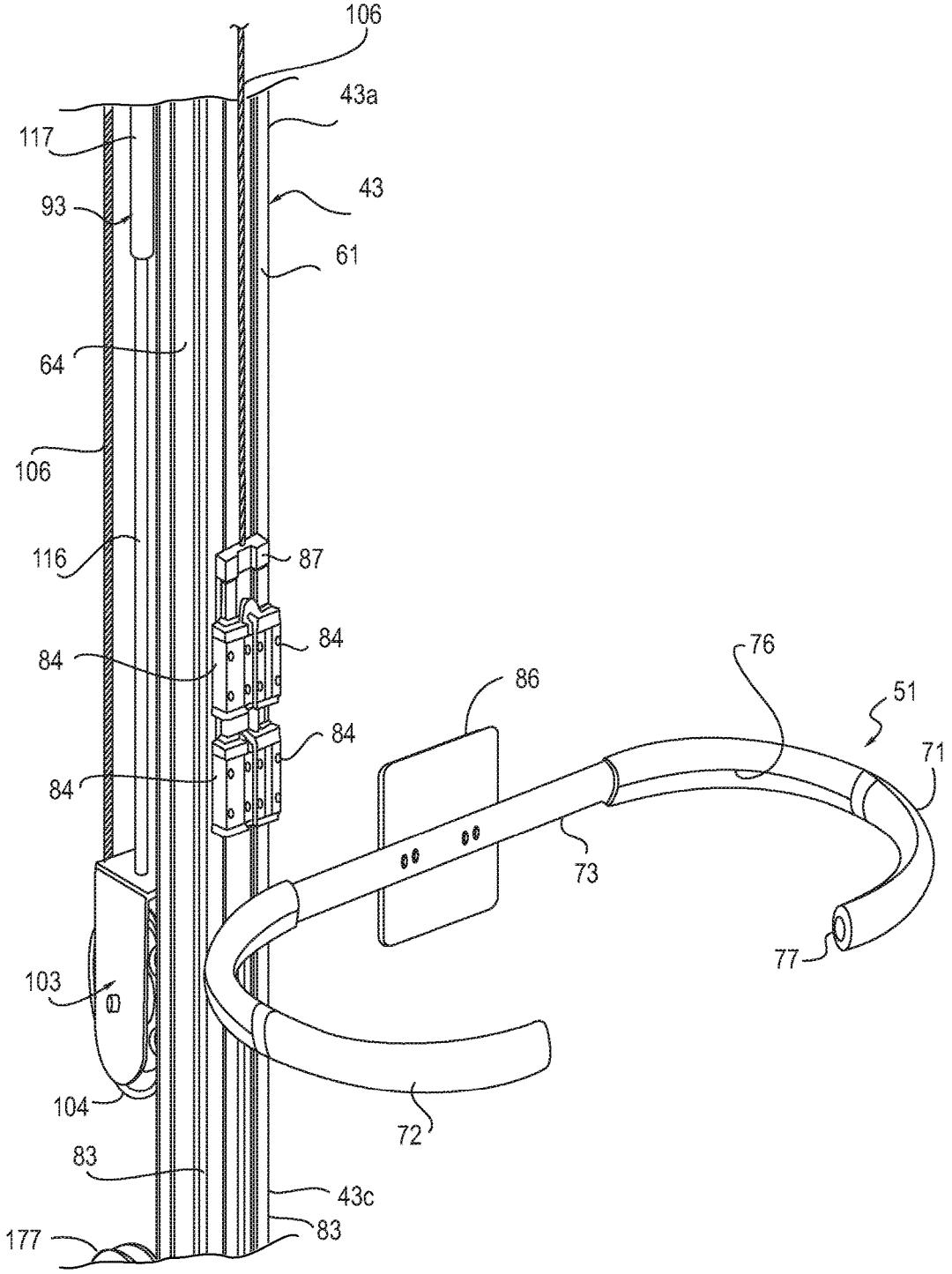
FIG. 7 is an enlarged view of the upper portion of the exercise apparatus of FIG. 1 with the upper body support element removed from the vertical support but visible.
Figure 8:
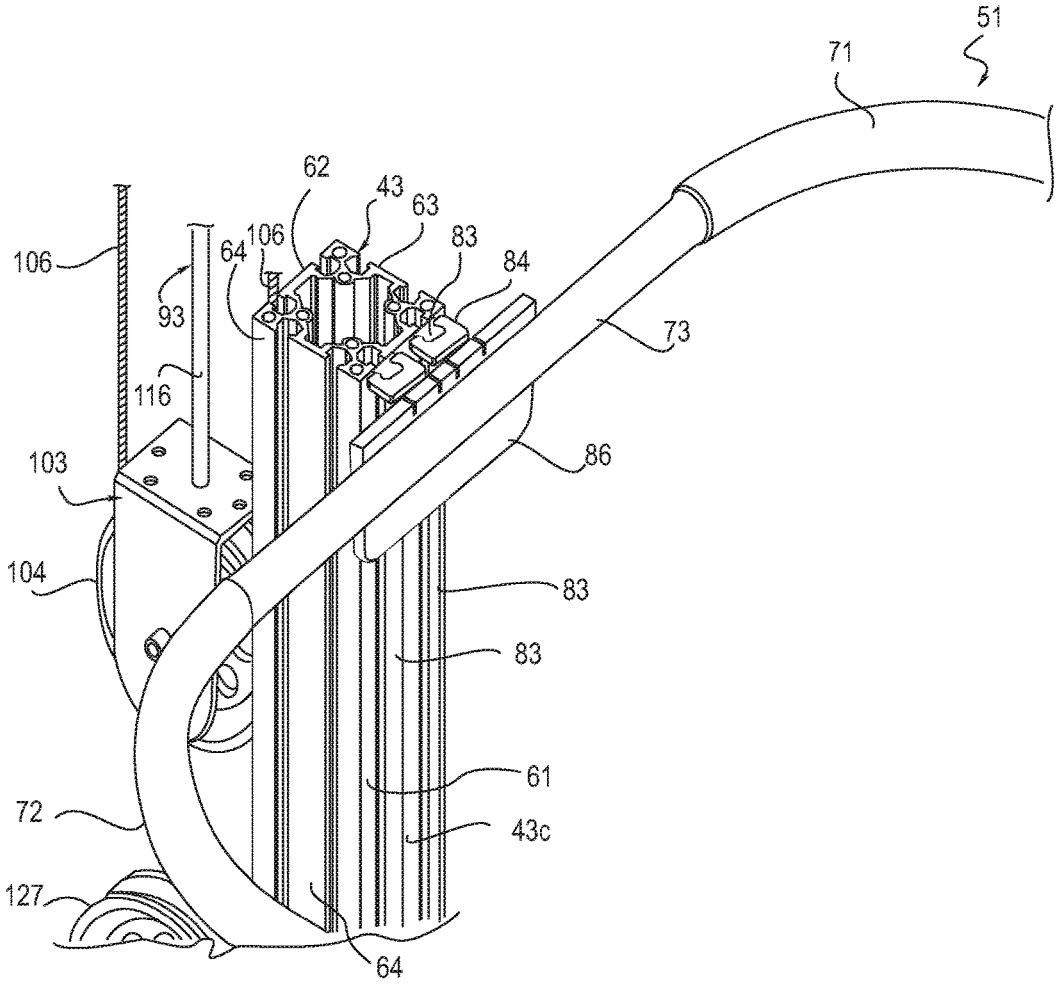
FIG. 8 is a cross-sectional view of the exercise apparatus of FIG. 1 taken along the line 8-8 of FIG. 3.
Figure 9:
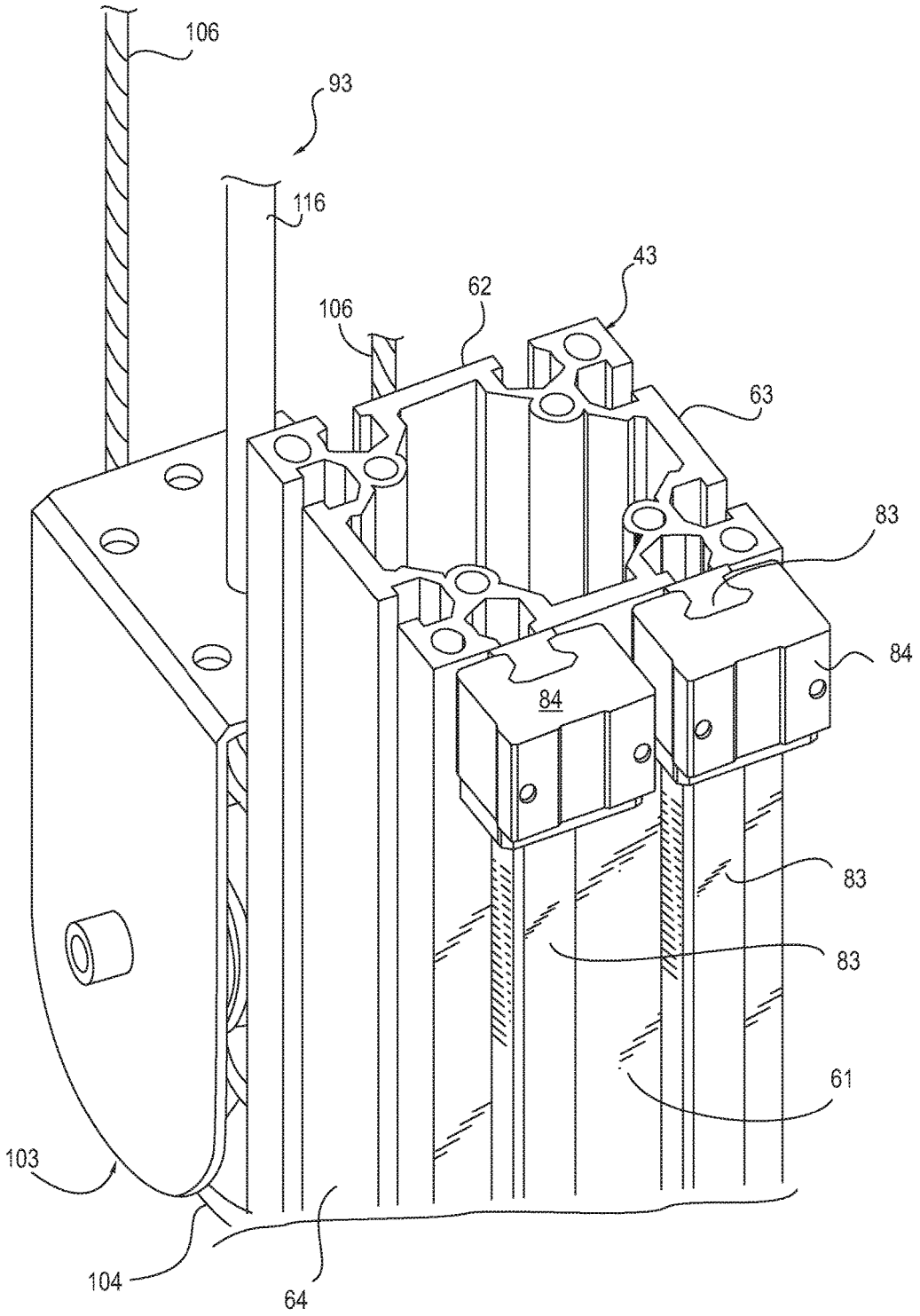
FIG. 9 is an enlarged view FIG. 8 with the upper body support element removed from the vertical support.
Figure 10:
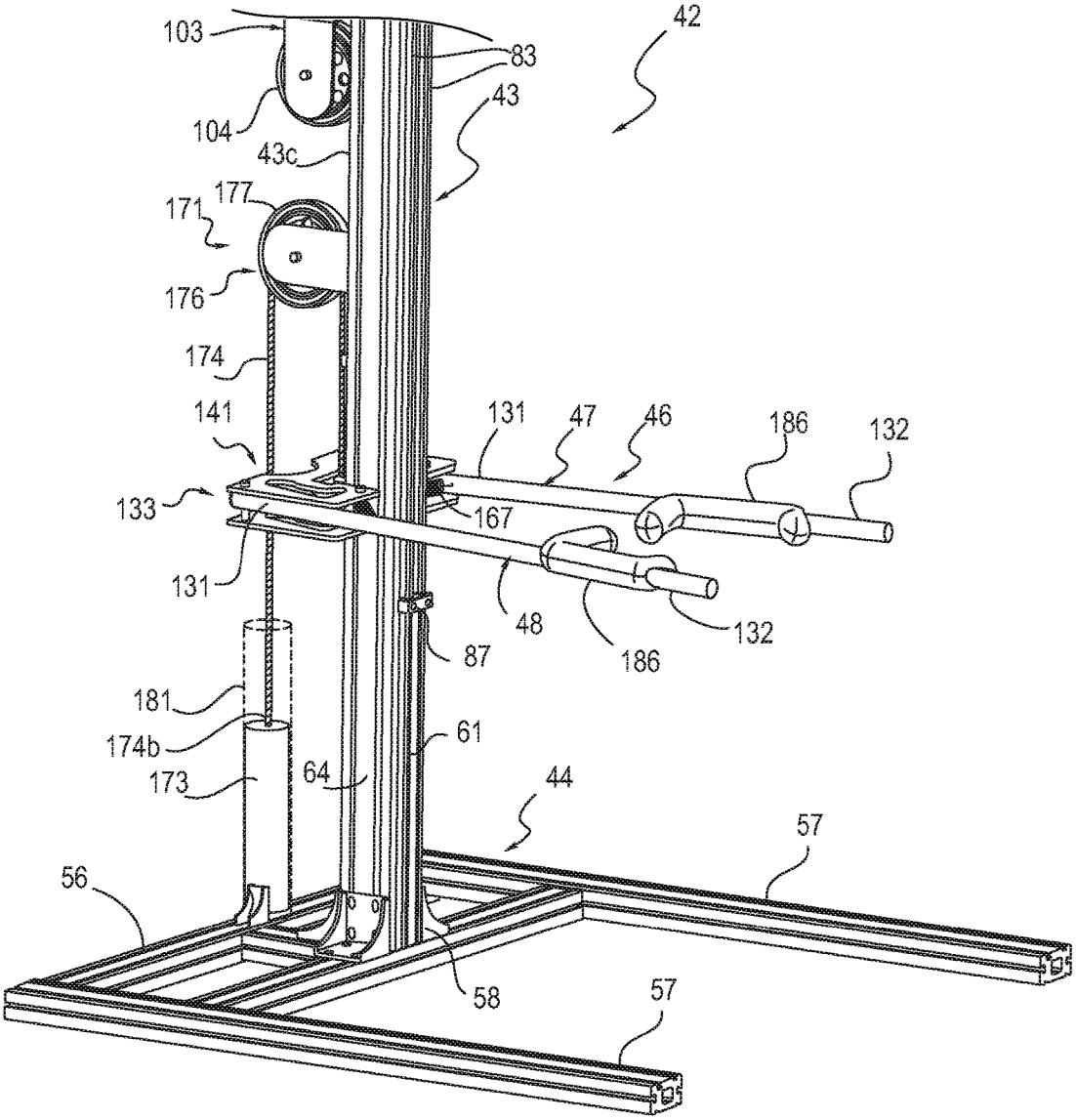
FIG. 10 is an enlarged view of the bottom portion of the exercise apparatus of FIG. 3.
Figure 11:
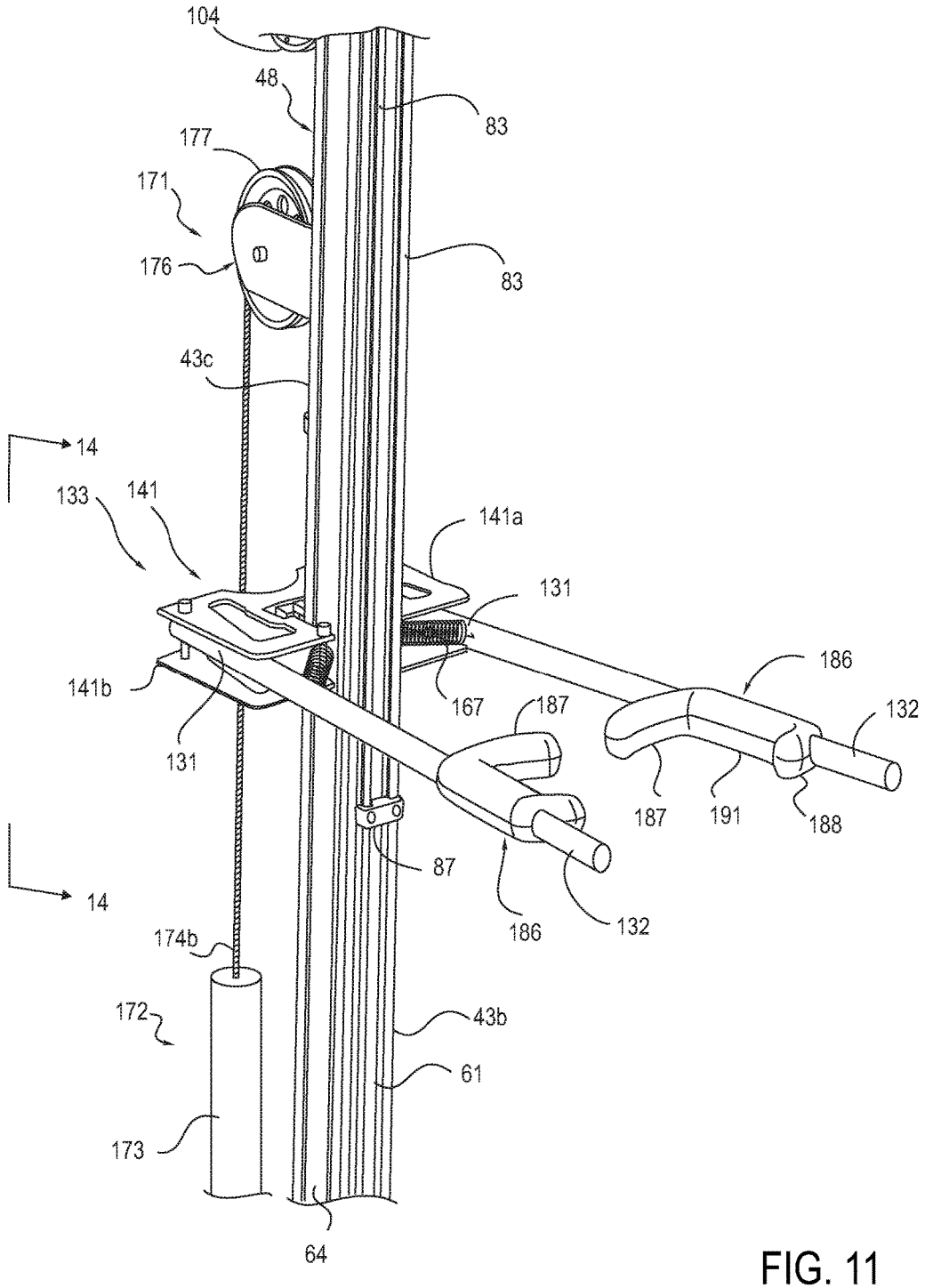
FIG. 11 is a further enlarged view, from a different perspective, of the arm assembly of FIG. 10.
Figure 12:
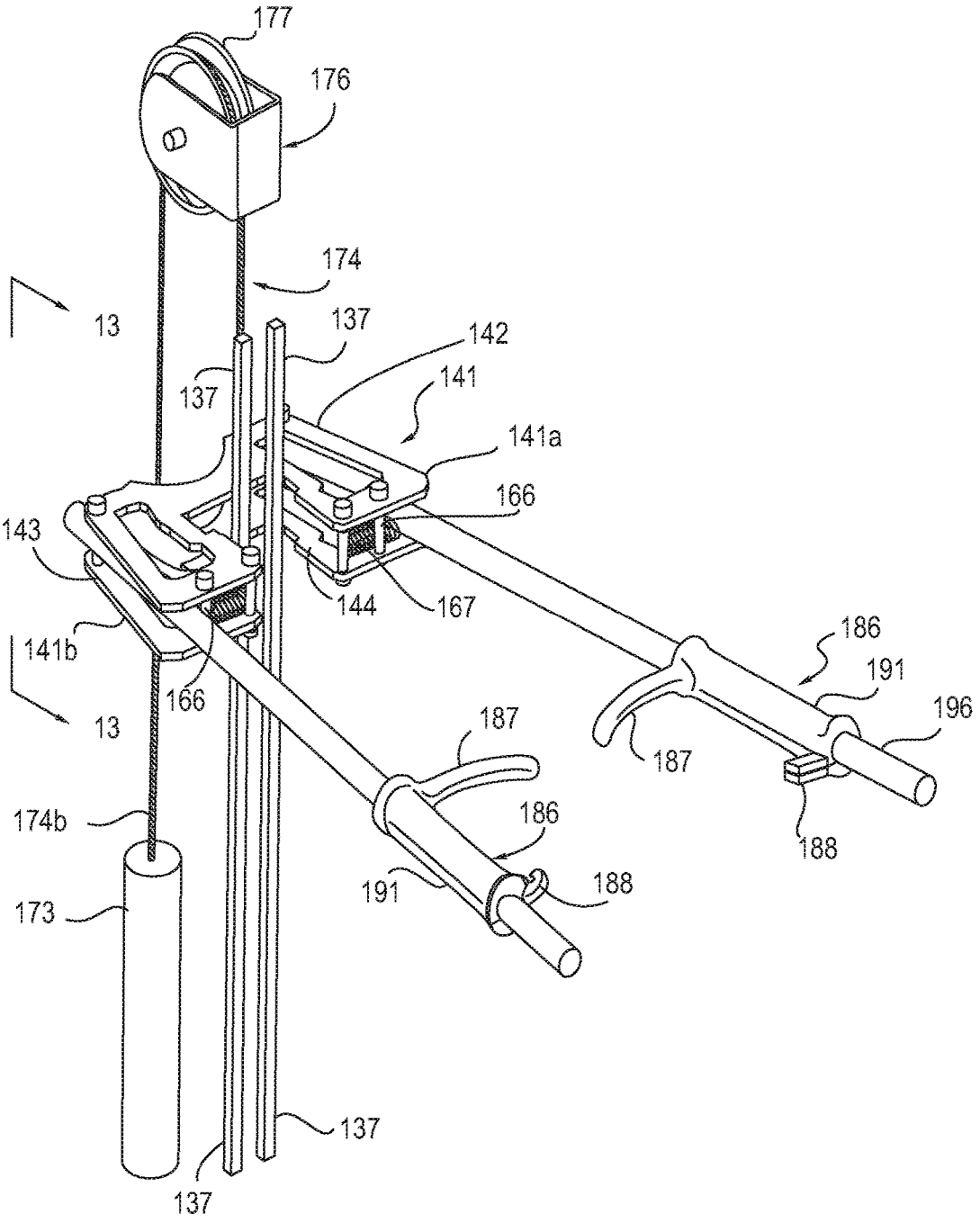
FIG. 12 is an exploded view of the arm assembly and coupling assembly of the exercise apparatus of FIG. 11 separated from the vertical support.
Figure 13:
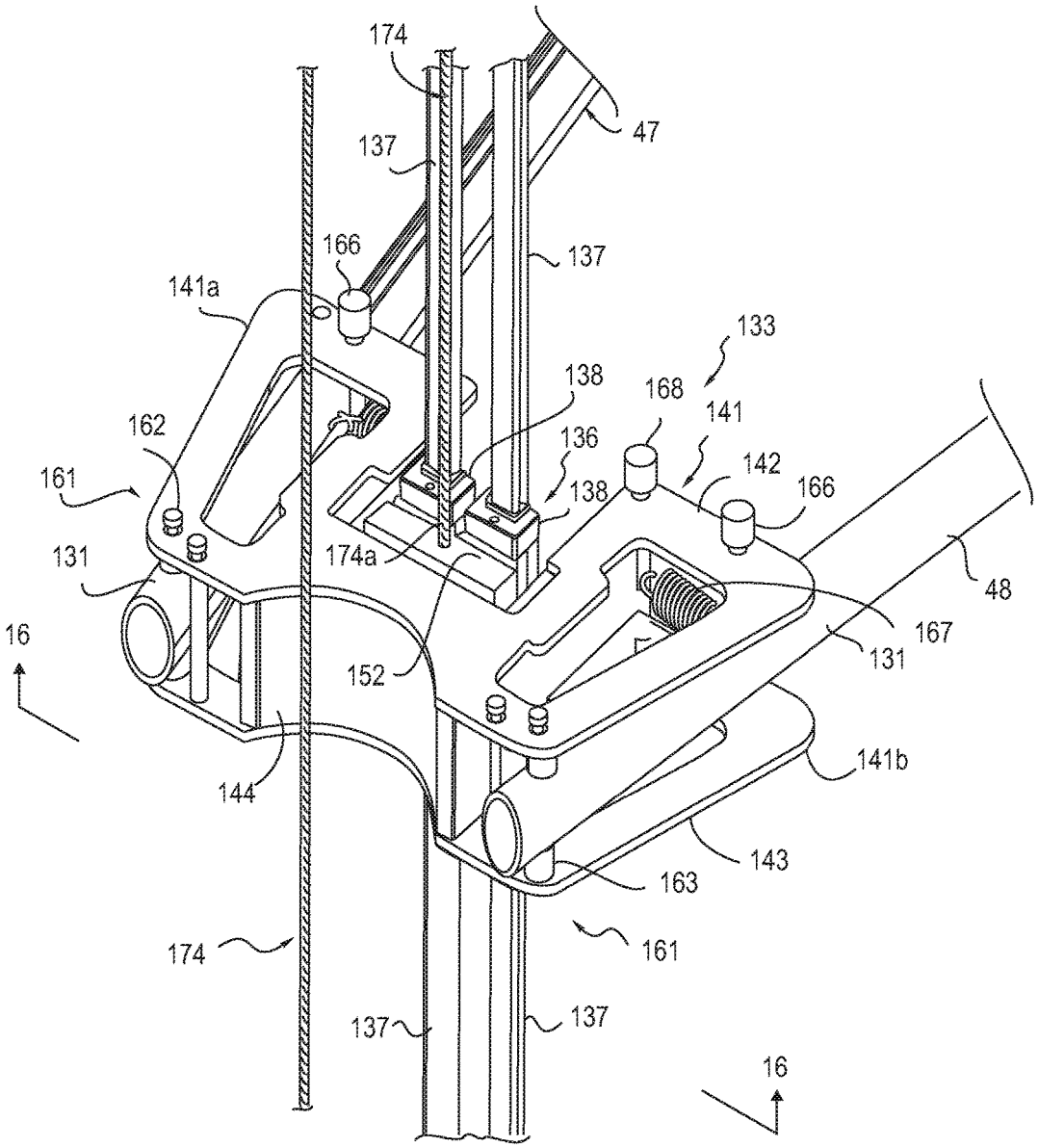
FIG. 13 is an enlarged view of the arm assembly and coupling assembly of FIG. 12 taken along the line 13-13 of FIG. 12.

In one embodiment, the apparatus of the invention combines four commonly used movements: squats-deep knee bends, ballet bar movements, butt machine movements and thigh machine movements. The user can change from a stooped posture to a half squat and down into deep-knee bend posture. In one embodiment, the user can move to a natural relaxed primal squat posture with the knees higher than the hips. The apparatus of the invention engages the gluteus maximus, the muscles specifically related to human beings and vertical posture. The gluteus maximus muscles secure the low back and stabilize the hips and knees for locomotion. In one embodiment, the user can move to a deep squat and at the same time internally and externally rotate the hips. In one embodiment, using telescoping forces applied thru plantar flexion, the user can stand back up from a deep squat into vertical posture. In one embodiment, apparatus of the invention allows the user to adjust the amount of tension used in the exercise.

The exercise device or apparatus of the invention can be used by a human having first and second legs, for example left and right legs, and first and second arms, for example left and right arms. In one embodiment, the device or apparatus of the invention includes a support structure carrying an arm assembly having first and second arms for respectively engaging the first and second legs of the human or user. The first and second arms of the arm assembly can pivot outwardly relative to each other from a contracted position to an extended position when engaged by the first and second legs of the user. In one embodiment, the outer portions of the first and second arms can optionally pivot upwardly and downwardly relative to the support structure, for example to accommodate the thighs of the user pivoting relative to the torso of the user while squatting. In one embodiment, the arm assembly can move upwardly and downwardly relative to the support structure to accommodate the user squatting relative to the support structure. In one embodiment, the apparatus of the invention optionally includes an upper body support element for engagement by the first and second arms of the user, for example to assist in steadying the user while moving from a vertical position to a squatting position and back to a vertical position relative to the support structure or to exercise the arms of the user.

The embodiments of the invention set forth below are examples of the invention, and may in some instances be broader than the foregoing embodiments of the invention but are not intended to limit the breadth of any of the foregoing embodiments or the breadth of the invention. Additional features of the invention set forth in such embodiments are optional. A feature of any embodiment set forth below can be combined with features from any of the foregoing embodiments, with or without any other feature of any embodiment set forth below. All characteristics, steps, parameters and features of the apparatus, devices or methods below are not limited to the specific embodiments or specific parts set forth below, but instead are equally applicable to any of the foregoing embodiments of the invention or to all embodiments of the invention. Broad terms and descriptors are replaced with more specific terms and descriptors not to limit a disclosure to a specific term or descriptor but merely for ease of discussion and understanding.

One embodiment of the apparatus or device of the invention is illustrated in FIGS. 1-21, where apparatus or device 41 is provided and includes a support structure 42 which can include a vertical element or support 43 secured to a suitable base 44. An arm assembly 46 is carried by the vertical support 43, and can include any suitable first and second arms such as left arm 47 and right arm 48. An optional upper body support element 51 can be carried by the vertical support 43.

Vertical support 43 and base 44 can be made from any suitable rigid material such as plastic or metal. The vertical support 43, which can be referred to as the main post, can be of any suitable size and shape, and in one embodiment has a length or height approximately equal to the height of an adult human. Base 44 has a shape and configuration for supporting apparatus 41, particularly during use. In one embodiment, the base or base plate is planar and rectangular in shape and provided with a rear portion 56 to which the vertical support 43 is attached and first and second feet 57 extending forwardly of the rear portion 56 in spaced-apart, parallel positions so as to form the left and right side boundaries of the base. The vertical support 43 has opposite first and second end portions or ends 43*a*, 43*b* and a central portion 43*c*. The second or bottom end portion 43*b* of the vertical support is secured to rear portion 56 of the base 44 by any suitable means such as a bracket 58. Vertical support 43 further includes a front 61 and a rear 62 extending between the end portions 43*a*, 43*b*. A first or left side 63 and a second or right side 64 are provided between the front 61 and rear 62 of the vertical support 43. Apparatus 41 can be provided with a housing 66 for covering and protecting certain of the components thereof. In one embodiment, the housing 66 includes a first or left portion 67 secured to the left side 63 of vertical support 42 and to base 44 and a second or right portion 68 secured to the right side 64 of the vertical support and to base 44 by any suitable means such as fasteners (not shown).

Upper body support element 51, which can be referred to as the upper arm, can be of any suitable size and shape and, in one embodiment, is planar and oblong when viewed in plan. The support element 51 can be made from any suitable rigid material such as metal or plastic and can include first and second arms, such as left arm 71 and right arm 72, and a central portion 73. The arms 71, 72 are adapted for engagement by the arms of the human or user and, in one embodiment, are each arcuate in configuration and extend outwardly and forwardly from central portion 43 in opposite directions. In one embodiment, each of the arms loops around a central space 76 formed by the upper body support element 51 to a front opening 77 for permitting the user to enter the central space 76. The central space 76 is sized to accommodate the torso of the user. The left and right arms of the user can rest on and around left and right arms 71, 72 of the upper body support element 51.

An assembly 81 is carried by vertical support 43 for securing the upper body support element 51 to the vertical support. Although the support element 51 can be rigidly secured to the vertical support 43, in one embodiment the support element 51 is slidably carried by the vertical support 43. In one such embodiment, the assembly 81 includes a slide assembly 82 for permitting the upper body support element 51 to move vertically on the vertical support 43 (see FIGS. 7-9). Slide assembly 82 can be of any suitable type and, in one embodiment, includes at least one rail 83 extending vertically along at least a portion of the front 61 of vertical support 43. In one embodiment, first and second rails 83 of equal length extend along front 61 in spaced-apart, parallel positions and are secured to the vertical support 43 by any suitable means such as screws, bolts or other fasteners (not shown). The rails 83 can be of any suitable length, for example to accommodate the vertical travel of the user while squatting relative to apparatus 41, and can be made from any suitable material such as metal or plastic. In one embodiment, the rails 83 have a length at least a long as a torso of an adult human. At least one slide 84 can be slidably mounted on each rail 83 and can be of any suitable type such as a bushing device or bushing. In one embodiment, first and second vertically spaced-apart slides 84 are provided on each rail 83. Central portion 73 of the upper body support element 51 is secured to slides 84 by any suitable means such as, for example, a plate element or plate 86 that can be bolted, screwed or otherwise fastened to each of the slides 84. Plate element or plate 86 can be referred to as a bracket or arm bracket. The central portion 73 of the support element 51 can be secured to the plate 86 by screws, bolts, fasteners or any other suitable means. In one embodiment, each of the rails 83 is mounted to front 61 of the vertical support 43 along its central portion 43*c* and in one embodiment the rails are mounted to approximately the central two thirds of the front of vertical support 43. A bumper 87 or other suitable stop can be mounted to front 61 of the vertical support 43 at the top and bottom of rails 83 so as to retain the slides 84 on the rails 83. In one embodiment, each of the rails 83 is provided with a plurality of vertically spaced-apart holes (not shown) along at least portions of the top and bottom thereof. Pins (not shown) can be removably inserted into such holes to customize the amount of travel of the slides 84 on rails, for example to accommodate the height of the user and the travel of the user along the vertical support 43 during operation and use of apparatus 41.

An assembly 91 can be provided and carried by support structure 42, for example by vertical support 43, four inhibiting or resisting movement of the upper body support element 51 as the support element 51 is moved downwardly along vertical support 43 by the user during operation of apparatus 41. See FIGS. 5-9. The assembly 91 can be of any suitable type and in one embodiment includes a force-exerting device or element 92 for resisting such movement of the upper body support element 51. The force-exerting device or element can be of any suitable type, for example a gas spring, a spring, weights or any combination of the foregoing. In one embodiment, the force-exerting device includes a gas spring or gas strut 93 carried by the top of vertical support 43. The gas spring 93 can be secured to the top of the vertical support by any suitable means. In one embodiment, first and second plates 96 are secured to respective sides 63, 64 of the vertical support 43 at top end portion 43*a* by any suitable means such as screws, bolts, or other fasteners. A brace 97 extends between and is secured to plates 96 and one end of the gas spring 93 is secured to the brace 97 so that the gas spring depends from the brace 97 and extends parallel to and spaced from the rear 62 of vertical support 43. A first pulley 101, having a pulley wheel 102, is provided and secured to the top of vertical support 43 between plates 96 by any suitable means such as screws, bolts or other fasteners. A second pulley 103, having a pulley wheel 104, is secured to the bottom and of gas spring 93. A cable 106 made from any suitable material such as metal is provided and has a first end 106*a* secured to the top of slides 84 and a second end 106*b* secured to a suitable tightening device 107 extending between and secured to plates 96 by any suitable means. The cable 106 extends from slides 84 along the front 61 of the vertical support 43 and around pulley wheel 102 at the top of the vertical support 43 and then down the rear 62 of the vertical support and around pulley wheel 104 secured to the end of gas spring 93. Tightening device 107 can be of any suitable type and in one embodiment includes a central pivot shaft 108 having first and second cam elements 111 secured to the pivot shaft and extending off center of the pivot shaft. In one embodiment, pivot shaft 108 extends perpendicularly between plates 86, and each of the plates 86 is provided with a through hole for receiving the respective end of the pivot shaft 108. A cam pin 112 is secured to and extends between the spaced-apart cam elements 111 parallel to pivot shaft 108. The second end 106*b* of cable 106 is secured to cam pin 112 by any suitable means such as a hook or eyelet 113 secured to the second end 106*b* of the cable. Tightening device 107 further includes a handle 114 secured to one end of pivot shaft 108. The handle can be referred to as a gas strut release handle.

Cable 106 can be of any suitable length. In one embodiment, the cable has a length so that when the first end 106*a* of the cable is attached to slides 84 positioned near the top of rails 83 the cable can extend over pulley wheel 102 of pulley 101 and then down rear 62 of vertical support 43 and around pulley wheel 104 of pulley 103, when gas spring 93 is in an extended position, and then up along the gas spring so that second end 106*b* of the cable can attach to cam pin 112 of tightening device 107. The rotation of pivot shaft 108 by means of handle 114 serves to tighten cable 106 relative to pulley wheels 102, 104 and gas spring 93. The gas spring 93 or other force-exerting device 92 can be of any suitable type and in one embodiment has a piston 116 that can be slidably received by or extend from a sleeve or housing 117. Gas spring 93 can be appropriately sized, that is provided so that piston 116 provides a predetermined tensile force, for accommodating the size, weight and strength of the user of apparatus 41. In one embodiment, the gas spring can be selected from one of a plurality of gas springs of difference force and easily installed on apparatus 41. In this regard, when it is desired to replace the gas spring 93 with another gas spring, handle 114 of tightening device 107 can be rotated in an appropriate direction so that cam pin 112 rotates about pivot shaft 108 of the tightening device and causes cable 106 to loosen relative to pulley 103. Thereafter, pulley 103 can be removed from the end of the gas spring and the gas spring decoupled from brace 97. Another gas spring can be secured to the brace at one end and to pulley 103 at its other end. The loosened cable 106 can be repositioned around pulley wheel 104 of pulley 103 and handle 114 of tightening device 107 rotated in an appropriate direction about pivot shaft 108 to cause the cable to tighten relative to pulleys 101, 103 and slides 84.

Arm assembly 46 is carried by vertical support 43, and in one embodiment secured to the vertical support 43, at the central portion 43*c* of the vertical support. The arm assembly 46 can be referred to as a lower arm assembly. In one embodiment, the arm assembly 46 has a home position near the bottom of rails 83. Arms 47, 48 of the arm assembly 46 can each be made from any suitable rigid material such as plastic or metal. Each of the arms 47, 48 has a first end portion 131 and a second end portion 132. A coupling assembly 133 is provided for securing the arm assembly 46 to the vertical support 43, and more specifically secures the first end portion 131 of each arm 47, 48 of the arm assembly 46 to the vertical support 43. The coupling assembly 133 can be of any suitable type and in one embodiment the arm assembly 46 is slidably carried by the vertical support 43 and the coupling assembly 133 includes a slide assembly 136 substantially similar to slide assembly 82 for permitting the arm assembly 46 to move vertically on the vertical support 43 (see FIGS. 10-14). Slide assembly 136 can be of any suitable type and, in one embodiment, includes at least one rail 137 extending vertically along at least a portion of the rear 62 of vertical support 43. In one embodiment, first and second rails 137 of equal length extend along rear 62 in spaced-apart, parallel positions and are secured to the vertical support 43 by any suitable means such as screws, bolts or other fasteners (not shown). The rails 137 can be of any suitable length, for example to accommodate the vertical travel of the user's gluteus maximus while squatting relative to apparatus 41, and can be made from any suitable material such as metal or plastic. At least one slide 138 can be slidably mounted on each rail 137 and can be of any suitable type such as a bushing device or bushing. In one embodiment, first and second vertically spaced-apart slides 138 are provided on each rail 137. In one embodiment, each of the rails 137 is mounted to rear 62 of the vertical support 43 along its central portion 43*c* and in one embodiment the rails are mounted to the bottom portion of vertical support 43. The vertical center of rails 137 are below the vertical center of rails 83. A bumper 139 or other suitable stop can be mounted to front 61 of the vertical support 43 at the top and bottom of rails 137 so as to retain the slides 138 on the rails 137. In one embodiment, each of the rails 137 is provided with a plurality of vertically spaced-apart holes (not shown) along at least portions of the top and bottom thereof. Pins (not shown) can be removably inserted into such holes to customize the amount of travel of the slides 138 on rails 137 to accommodate the height of the user and the travel of the user's gluteus maximus along the vertical support 43 during operation and use of apparatus 41.

Coupling assembly 133 receives the first end portion 131 of each of left arm 47 and right arm 48 of arm assembly 46. In one embodiment, a housing 141 is provided for receiving arm first end portions 131. The housing 141, which can be referred to as a bracket, can be of any suitable type and can include a first or left side portion 141*a* for receiving left arm 47 and a second or right side portion 141*b* for receiving right arm 48. In one embodiment, the housing 141 includes a first or upper plate 142 and a second or lower plate 143 each secured to a block 144 provided between plates 142, 143 by any suitable means such as screws, bolts or other fasteners (see FIGS. 13, 15 and 16).

Figure 14:
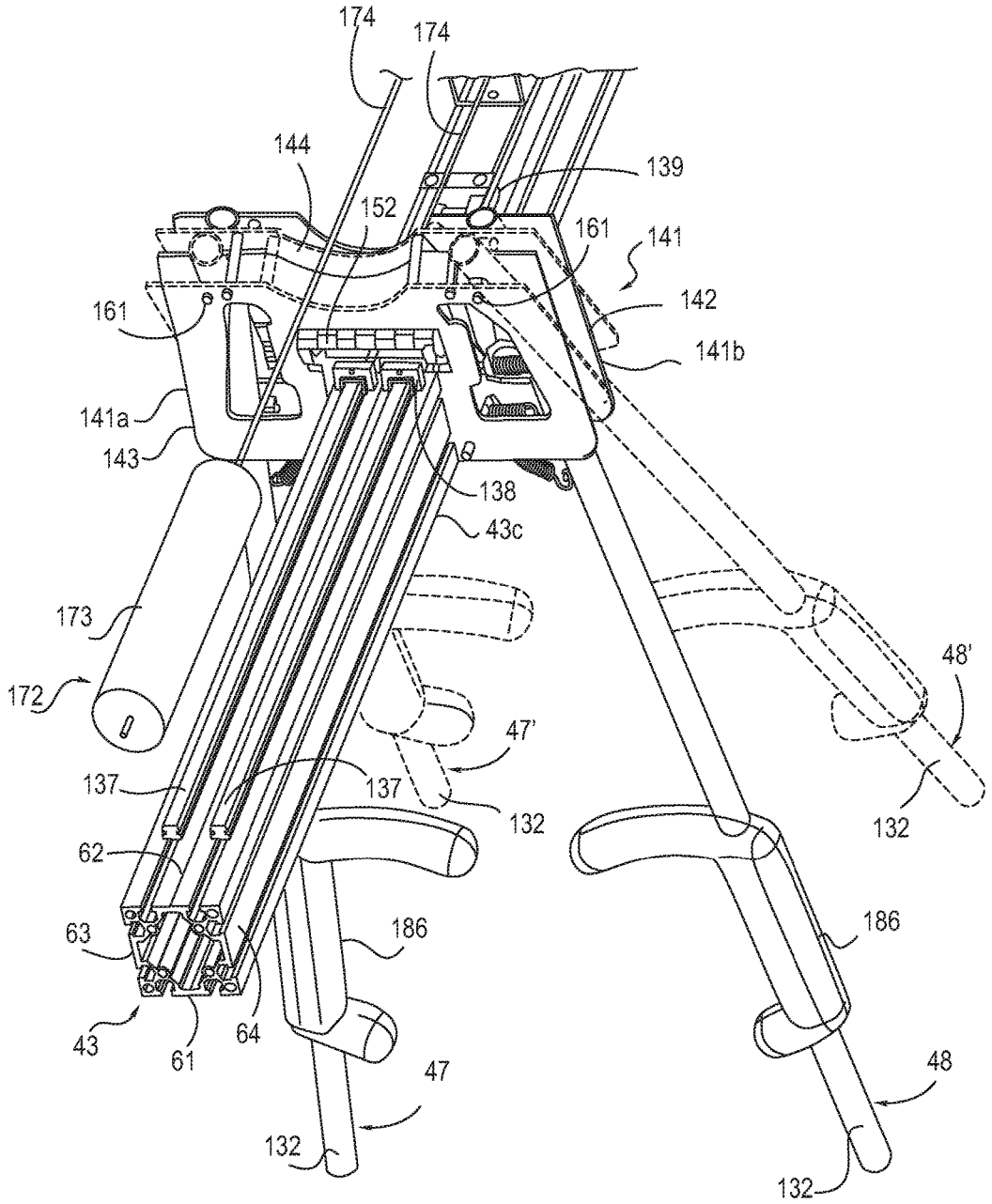
FIG. 14 is a rear perspective view of the arm assembly, coupling assembly and vertical support of FIG. 11 taken along the line 14-14 of FIG. 11 and showing the first and second arms of the arm assembly in a horizontal position and in an inclined position relative to the vertical support.
Figure 15:
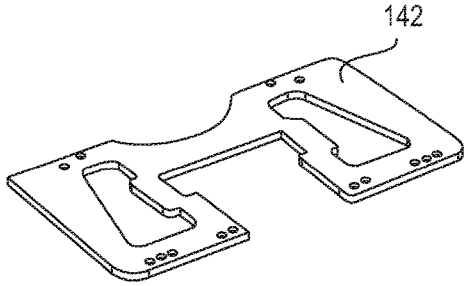
FIG. 15 is an exploded view of the arm assembly, and the pivot assembly of the coupling assembly for securing the arm assembly to the vertical support, of the exercise apparatus of FIG. 1.
Figure 15:
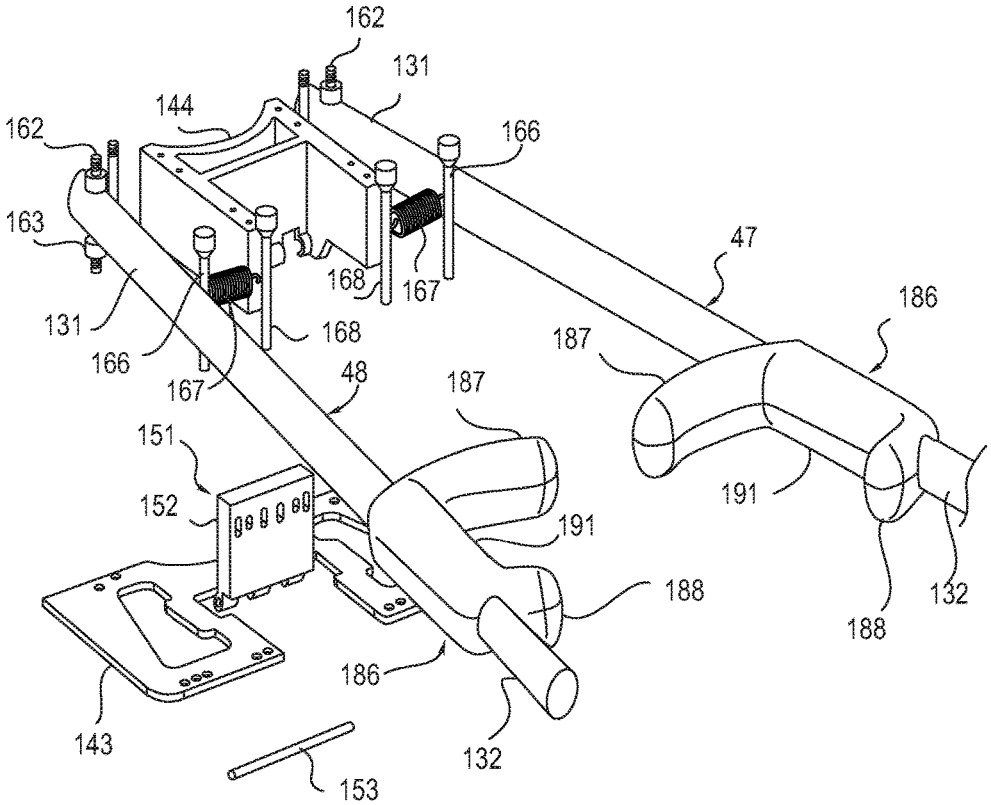
Figure 16:
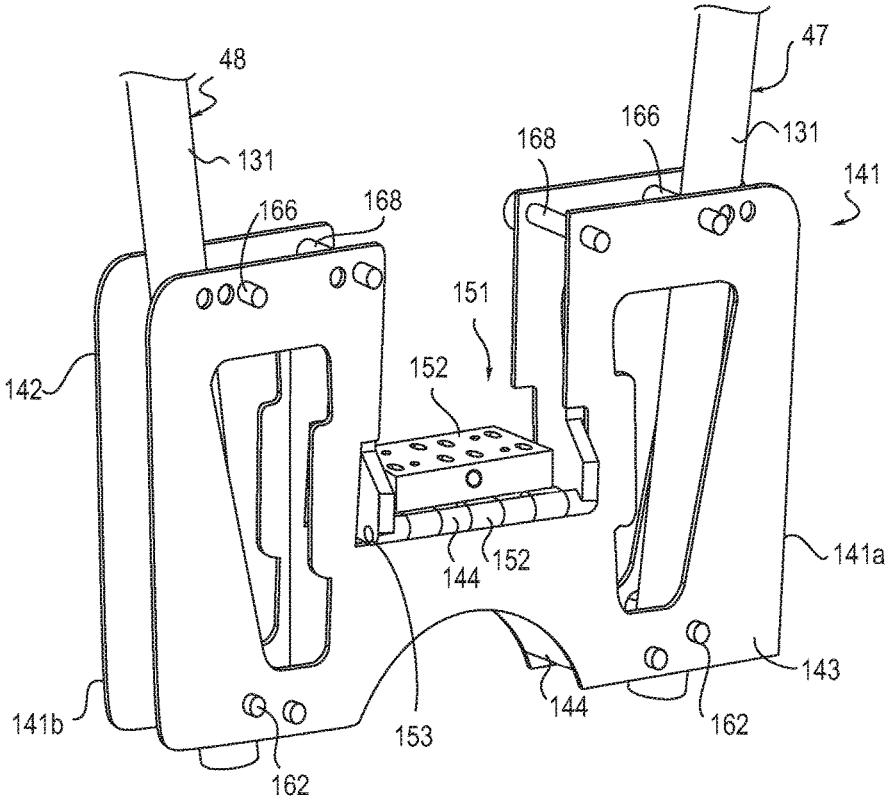
FIG. 16 is a bottom plan view of a portion of the arm assembly, and the pivot assembly of the coupling assembly for securing the arm assembly to the vertical support, of the exercise apparatus of FIG. 1 taken along the line 16-16 of FIG. 13.

In one embodiment, a pivot assembly 151 is provided to permit arm assembly 46 to pivot relative to support element 43. The pivot assembly 151 permits second end portions 132 of each arm 47, 48 to pivot upwardly and downwardly relative to the vertical support 43 between first and second positions. In one embodiment, arms 47, 48 of arm assembly 46 pivot between a first or horizontal position and a second or inclined position and in one embodiment the arms 47, 48 pivot between such horizontal position and inclined position independent of arm assembly 46 moving vertically on vertical support 43. Pivot assembly 151 can be of any suitable type and in one embodiment includes a hinge plate 152 that is pivotally coupled to housing 141 by any suitable means such as a pivot pin 153. In one embodiment, hinge or pivot plate 152 is pivotally coupled to block 144 by the pivot pin 153, for example is illustrated in FIGS. 14-16. Pivot assembly 151 can be included in coupling assembly 133 and, in one embodiment, hinge plate 152 serves to secure housing 141 to slides 138 by any suitable means such as screws, bolts or other fasteners. Housing 141, and arms 47, 48 carried thereby, can thus pivot relative to vertical support 43 between a first or horizontal position shown by left arm 47 and right arm 48 in FIG. 14 and a second or inclined position shown by left arm 47' and right arm 48' in FIG. 14. Second end portions 132 of the arms 47, 48 can move upwardly relative to vertical support 43 when they pivot from the horizontal position to the inclined position.

Figure 17:
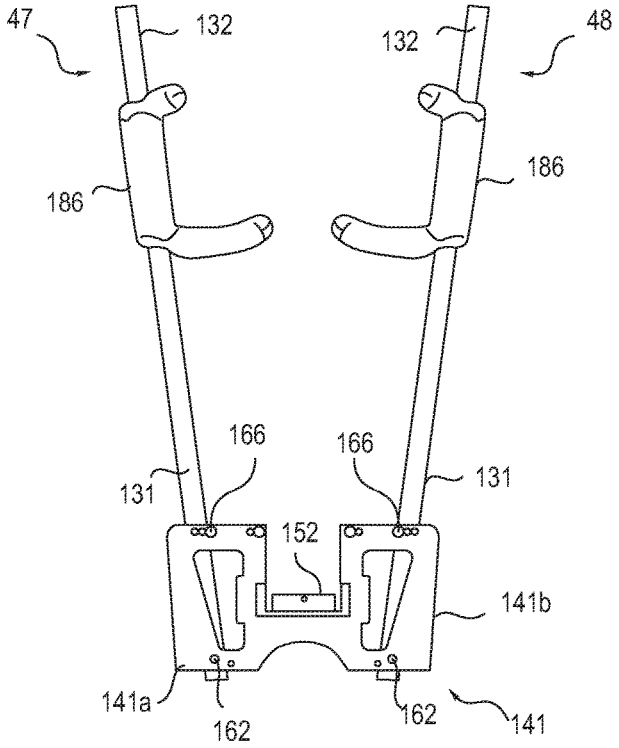
FIG. 17 is a top plan view of the arm assembly of the exercise apparatus of FIG. 1 in a first or contracted position.
Figure 18:
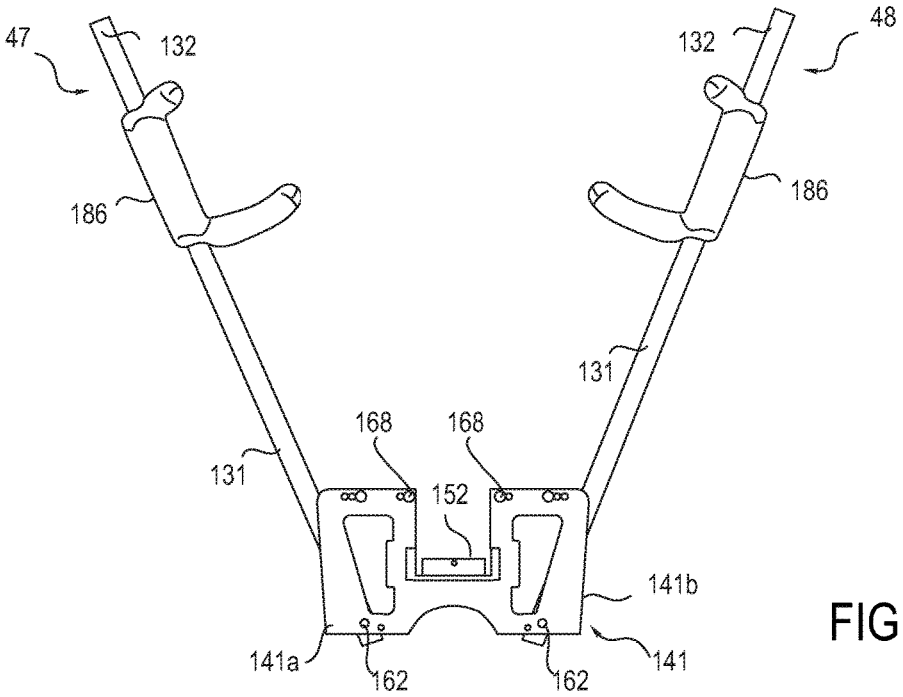
FIG. 18 is a top plan view of the arm assembly of the exercise apparatus of FIG. 1 in a second or extended position.

In one embodiment, a pivot assembly 161 is provided to permit first or left arm 47 and second or right arm 48 to move between a contracted position, in which second end portions 132 of the arms are relatively close to each other for example as illustrated in FIG. 17, and an extended position, in which second and portions 132 are pivoted away from each other for example as illustrated in FIG. 18 so as to be at a greater angle relative to each other than when in the contracted position as viewed in plan. Pivot assembly 161 can be of any suitable type and in one embodiment includes a pivot element or pivot pin 162 extending through first end portion 131 of the respective left arm 47 or right arm 48. Each of the first and second pivot pins extends perpendicularly between plates 142, 143 of housing 141 in the respective side portion 141*a*, 141*b*. Each of the plates 142, 143 can be provided with a through hole or bore for receiving each pivot pin 162. In one embodiment, a sleeve 163 is provided for each pivot pin and extends through the respective first end portion 131 of the respective arm and between plates 142, 143. A pin 162 extends through each of the sleeves 163 and each pin can have a cap or head at one end and a nut or other fastener at the other end for securing the pin 162 and sleeve 163 to housing 141. Each of the sleeves 163 pivots with the respective arm 47, 48 relative to the respective pin 162 and housing 141. Pivot assembly 161 can be included in coupling assembly 133.

A limiter 166 of any suitable means can be provided in housing 141 for limiting the travel of a respective left arm 47 or right arm 48 relative to housing 141 and vertical support 43. In one embodiment, limiter 166 limits the contraction of each of the arms 47, 48 when in the first or contracted position. Each limiter 166 can be of any suitable type and in one embodiment includes a pin extending between upper plate 142 and lower plate 143 in each left side portion 141*a* and right side portion 141*b* of housing for engaging the respective arm 47, 48 when the arm is moving inwardly towards the other arm. The pin 166 can be secured at each end to the respective plate 142, 143. A means or mechanism 167 can be included in apparatus 41 for each of left arm 47 and right arm 48 for urging the arm towards its first or contracted position. Such means or mechanism can be of any suitable type and in one embodiment can include a spring 167 having a first end coupled to the inside of the respective arm 47, 48 by any suitable means such as a screw, bolt or other fastener and a second end hooked or otherwise secured to housing 141 by any suitable means. Each spring 167 can be referred to as an extension spring. In one embodiment, the second end of each spring 167 is secured to a pin 168, which can be referred to as a spring pin, extending between upper plate 142 and lower plate 143 and secured at each end to the respective plate. A variety of springs 167 can be provided for apparatus 41 to selectively adjust the amount of force exerted by arms 47, 48 on the legs of the user during use of the apparatus.

Slide assembly 136 permits arm assembly 46 to move vertically on vertical support 43 between a first or upper position, for example so that each of arms 47, 48 when in their first or horizontal position can engage the knees of a user standing in front of apparatus 41, and a second lower position, for example such that housing 141 and first end portions 131 of each of the arms 47, 48 is at the height of the hips of the user when the user is in a squatting position relative to apparatus 41. A mechanism, device or assembly 171 can be included in apparatus 41 for urging arm assembly 46 towards its first or upper position. Assembly 171 can be of any suitable type and in one embodiment includes a force-exerting device 172 coupled to the arm assembly for so urging the arm assembly towards its upper position. The force-exerting device 172 can be of any suitable type, for example a gas spring, a spring, a weight or any combination of the foregoing. In one embodiment of assembly 171, the force-exerting device 172 includes a weight 173 coupled to coupling assembly 133 by means of any suitable element such as a cable 174. See FIGS. 10-14. Weight 173 can be referred to as a counter balance weight. Assembly 171 can include a pulley 176 secured to rear 62 of vertical support 43 above rails 137 by any suitable means. The pulley 136 can include a pulley wheel 177 for receiving cable 174. First end 174*a* of the cable can be secured to housing 66, for example the top of hinge plate 152. The cable can extend up the rear 62 of vertical support 43 from the housing 141 over pulley wheel 177 and have a second end 174*b* depending from pulley 176. Weight 173 can be secured to the second end 174*b* of the cable. A containment device 181 of any suitable type, for example a containment cylinder, can be included in apparatus 41 for receiving weight 173 throughout its vertical travel. The containment cylinder 181, or other containment device, can thus inhibit the counterbalance weight 173 from swinging relative to vertical support 43.

Figure 19:
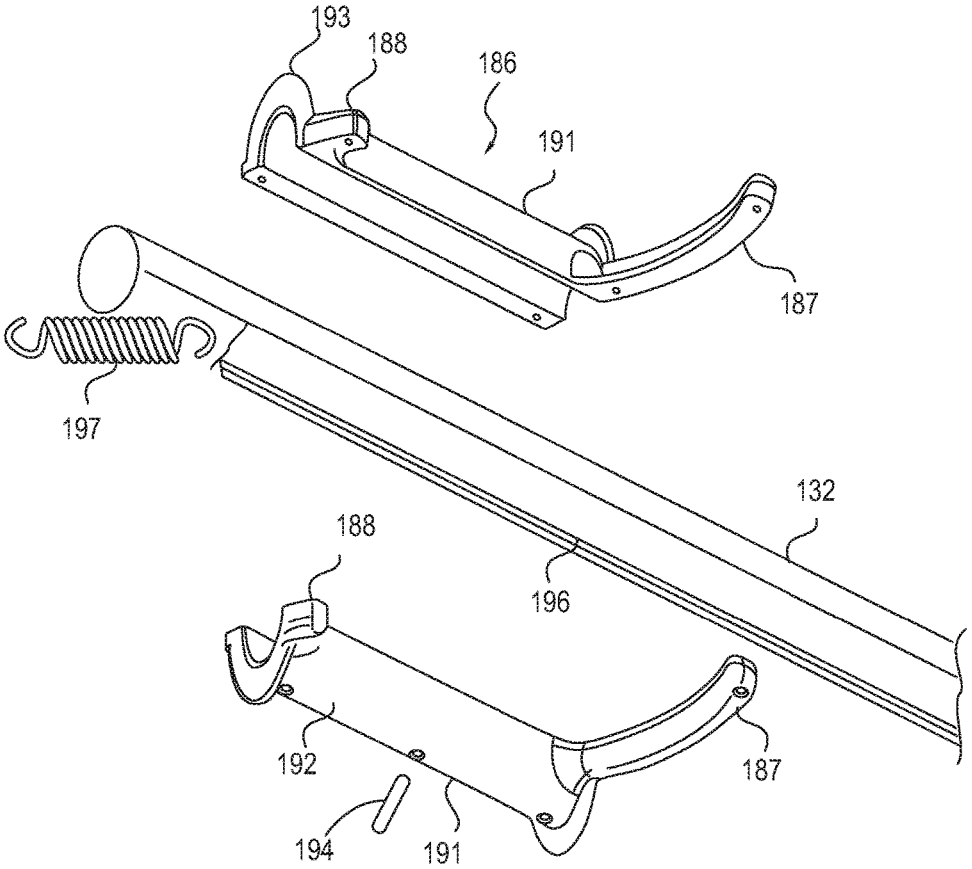
FIG. 19 is an exploded view of one of the arms of the arm assembly of the exercise apparatus of FIG. 1.

Grips or connects 186 can be provided with arm assembly 46 for retaining the user's knees or legs in a desired position relative to the left and right arms 47, 48 during utilization of apparatus 41 by a user (see FIGS. 17-19). A first grip when 186 can be provided on second end portion 132 of left arm 47 and a second grip when 186 can be provided on the second end portion 132 of right arm 48. The grips or connects 186, which can be referred to as knee connects or pads, can be of any suitable type and in one embodiment each includes a first extension 187 for engaging the rear of the knee of the user. Each of the grips or connects 186 can additionally include a second extension 188 for engaging the front of the knee of the user. In one embodiment, each of the grips or connects 186 includes a sleeve 191 that extends around the respective second end portion 132. The first extension 187 extends from one end of sleeve 191 and the second extension 187 extends from the other end of the sleeve. In one embodiment, the grip or connect 186 is slidably mounted on the respective second end portion 132 of the arm 47, 48 for longitudinal travel between first and second positions along the arm. In one embodiment, each grip or connect 186 is formed from a first housing portion 192 and second housing portion 193 which mount about the respective arm and are secured together by any suitable means such as screws, bolts, fasteners or adhesive. A suitable non-rotation element of any type, for example a pin 194, can be included in each grip 186 for inhibiting rotation of the grip about the respective arm 47, 48 so as to retain the first and second extensions 187 and 188 in desired circumferential positions about the arm. The pin 184 can extend inwardly from the sleeve 191 of the grip. A cooperating element or feature can be provided in each of the arms 47, 48, for example a slot 186 extending along a portion of the length of the arm, for receiving pin 194 and restricting rotation of the grip 186 about the arm and for guiding the longitudinal travel of the grip 186 along the arm. The slot 186 can be of a predetermined length so as to limit the longitudinal travel of the grip 186 along the respective arm 47, 48. Force-exerting or urging means can be included in each of the arms for urging the respective grip 186 towards one of its longitudinal positions on the arm 47, 48. For example, a spring 197 can be provided within each tubular arm 47, 48 and have a first end secured to the second end portion 132 of the arm and a second end secured to pin 194 extending from sleeve 191 of the grip 186 so as to urge the grip towards the free end of the arm.

In one embodiment, apparatus 41 is free of a seat, that is does not include a bench, stool or other seat to permit the user to sit, while left and right arms 47, 48 move between their contracted and extended positions about the legs and knees of the user. It is appreciated, however, that an embodiment of apparatus 41 can be provided with a seat or apparatus 41 and be used with a seat.

In one method of operating apparatus 41, a user steps in front of the apparatus with his or her back to vertical support 43. The user, for example the torso of the user, enters upper body support element 51 by means of front opening 77. The legs of the user are disposed between left arm 47 and right arm 48 of arm assembly 46. The user's feet are positioned between first and second feet 57 of base 44. The user can commence an exercise regime utilizing apparatus 41 by placing his or her arms on upper body support element 51, for example to support the user. In this regard, left arm 71 and right arm 72 of the support element 51 arc site outwardly and forwardly of vertical support 43 so as to permit the outstretched arms of the user to extend over the respective arms 71, 72 of the upper body support element 51. Alternatively, the user can grasp the upper body support element with the user's hands. In one method of operation, the user pulls the upper body support element 51 downwardly against the force of gas spring 93 to exercise the user's arms and positions the upper body support element 51 beneath the arms of the user.

In one method of operation, while in a standing position the user moves arm assembly 46 to an appropriate vertical position on vertical support 43 so that grips 86 on each arm 47, 48 are aligned with the knees of the user and first extensions 187 of the grips extend behind the respective knees of the user. For example, the user can slightly bend his or her knees so that left and right arms 47, 48 respectively engage the left and right knees of the user. The knees can then be pivoted outwardly relative to each other in one or more repetitions. Once the knees are slightly bent, the user can engage left and right grips 186 of the apparatus 41 with his or her knees. In one embodiment, the user moves slightly away from vertical support 43 so that each of the knees can more easily be positioned between first and second extensions 187 and 188 of the respective grip.

The user can commence a series of squat exercises whereby the user retains his or her upper body in a vertical position, for example with the assistance of upper body support element 51, and bends his or her legs at the knees so as to squat downwardly relative to the vertical support 43 during such downward travel. In one embodiment, the user can be continuously pivoting his or her knees outwardly against the force of left and right arms 47, 48 while so squatting downwardly. Pivot assembly 161 permits left and right arms 47, 48 to move between a contracted position when the left and right legs of the user are generally extending alongside each other and an extended position when the left and right legs of the user are pivoted away from each other. Slide assembly 136 permits arm assembly 46 to move vertically on support element 43 between an upper position and a lower position so as to facilitate alignment of the arms 47, 48 with the legs or knees of the user as a user moves downwardly relative to vertical support 43. Left and right arms 47, 48 remain secured to the knees of the user by means of grips 186. Arm assembly 46 travels downwardly on rails 137 and the second end portions 132 of the arms simultaneously pivot upwardly by means of pivot assembly 151 relative to vertical support 43 so that arms 47, 48 of apparatus 41 can remain generally parallel to the thighs of the user as the user squats downwardly to a deep squat position. If necessary, the user can gradually step backwardly and approach vertical support 43 while squatting downwardly so that the knees more readily engage grips 186. Each of the grips 186 is slidably mounted on the respective arm 47, 48 to facilitate continued engagement of the user's knees with the grips. Upper body support element 51 can serve to provide support and stability to the user during such downward squatting movement. In this regard, slide assembly 82 permits upper body support element 51 to move vertically on vertical support 43 between an upper position when the user is in a standing position and a lower position when the user is in a squat position, for example to provide support as the user moves between the standing position and the squat position.

Figure 21:
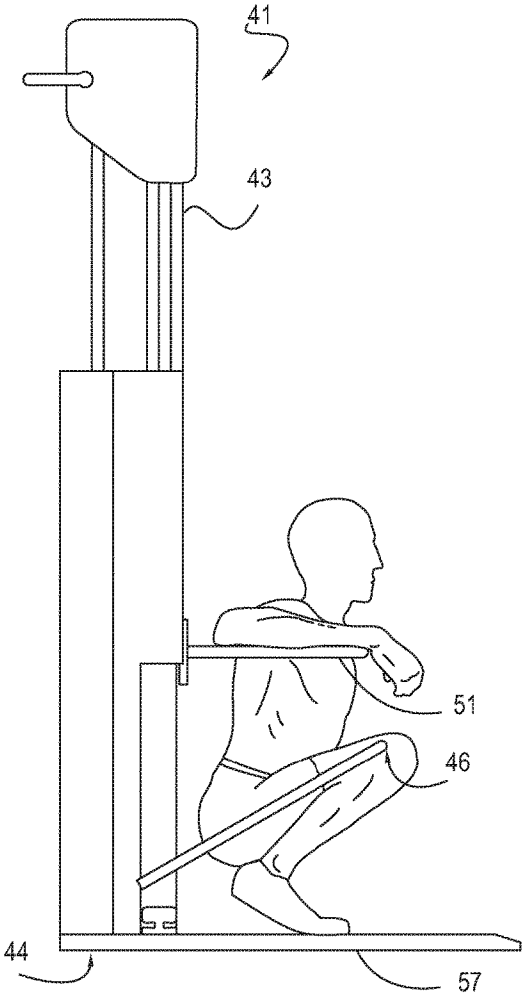
FIG. 21 is a side elevational view of the exercise apparatus of FIG. 1 with a user in an operational position with respect thereto.
Figure 20:
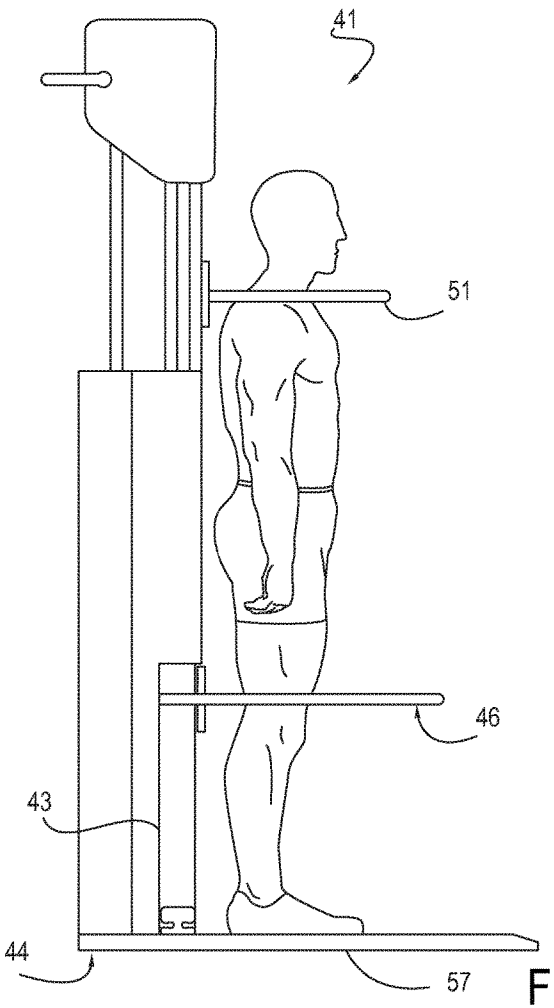
FIG. 20 is a side elevational view of the exercise apparatus of FIG. 1 with a user in a start position with respect thereto.

The user can then return to a vertical upright or standing position, again supported by upper body support element 51 if desired. Slide assembly 136 and pivot assembly 151 of coupling assembly 133 permit arm assembly 46 to travel upwardly and remain engaged with the knees of the user as the user returns to a standing position. At any point during this vertical travel, including while standing vertically upright or in a deep squat, the user can pivot his or her legs outwardly against the force of springs 167 of arm assembly 46 and exercise the user's gluteus maximus muscles. When the user's knees are so pivoted outwardly while in a deep squat, for example as illustrated in FIG. 21, left arm 47 and right arm 48 of arm assembly 46 can be in general registration with, for example parallel to, the thighs of the user.

In another method of utilizing apparatus 41 in an exercise regime, the user can grab upper body support element 51 with his or her hands and push the support element 51 downwardly in a series of repetitions. In each repetition, the support element 51 can be moved vertically within any desired range, for example from a height generally equal to the armpits of the user to a height where the arms of the user are fully extended downwardly. The user can face vertical support 43 during such regime, or step within upper body support element 51 and face away from the vertical support 43. This exercise regime can be utilized to exercise the back or arms of the user, for example the triceps.

In another method of utilizing apparatus 41 in an exercise regime, the user removes left and right arms 47, 48 from coupling assembly 133, for example by removing pivot pin 162 from housing 141 with respect to each of the arms, and places a small stool or bench underneath upper body support element 51 of the apparatus. The user reaches up and grasps the upper body support element 51 with his or her hands and pulls the support element 51 downwardly in one or more repetitions. In another similar method of operation, the user simply squats beneath upper body support element 51, without the assistance of a stool or bench, and pulls the upper body support element 51 downwardly in one or more repetitions.

Figure 22:
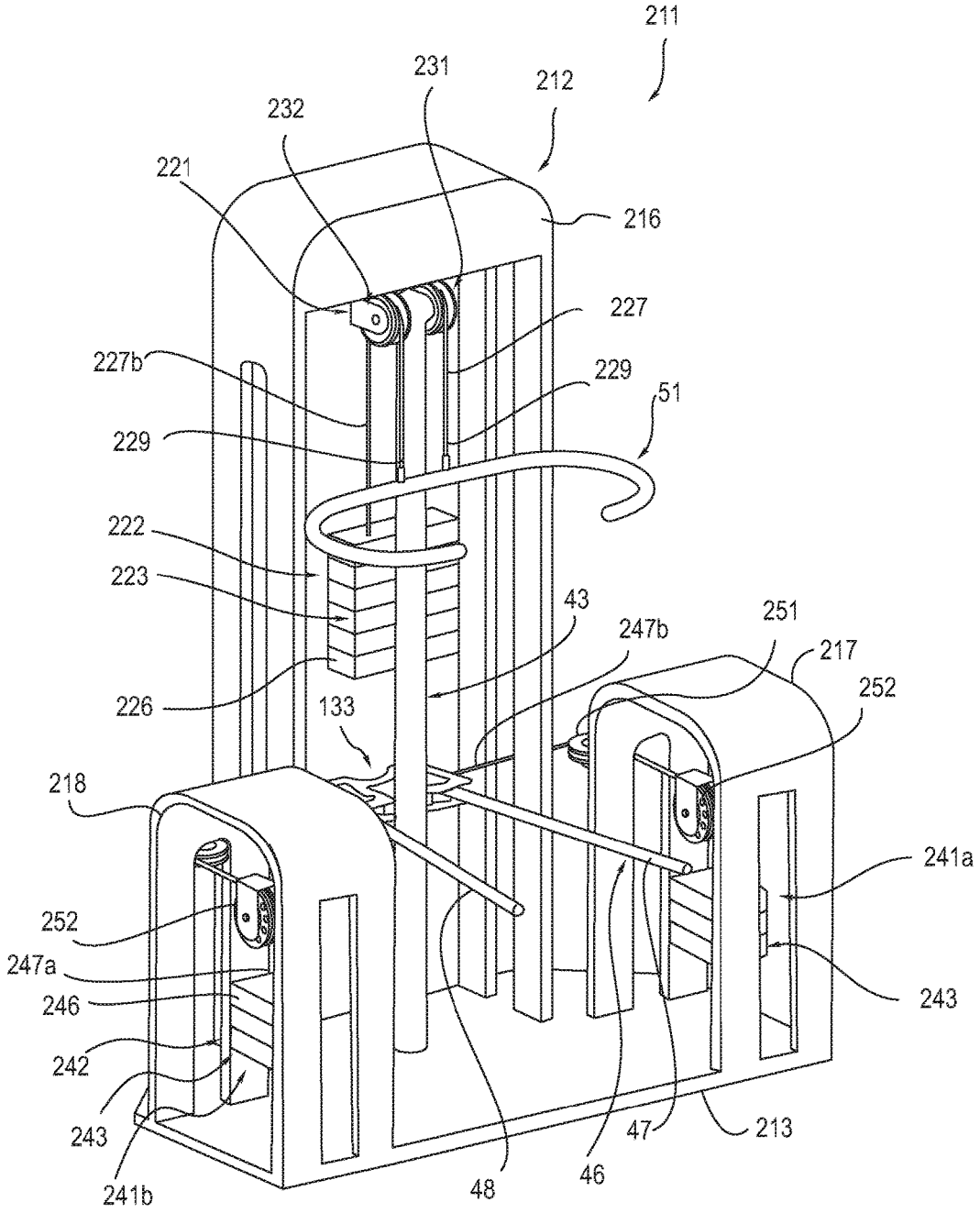
FIG. 22 is a front perspective view of another embodiment the exercise apparatus of the present invention.
Figure 23:
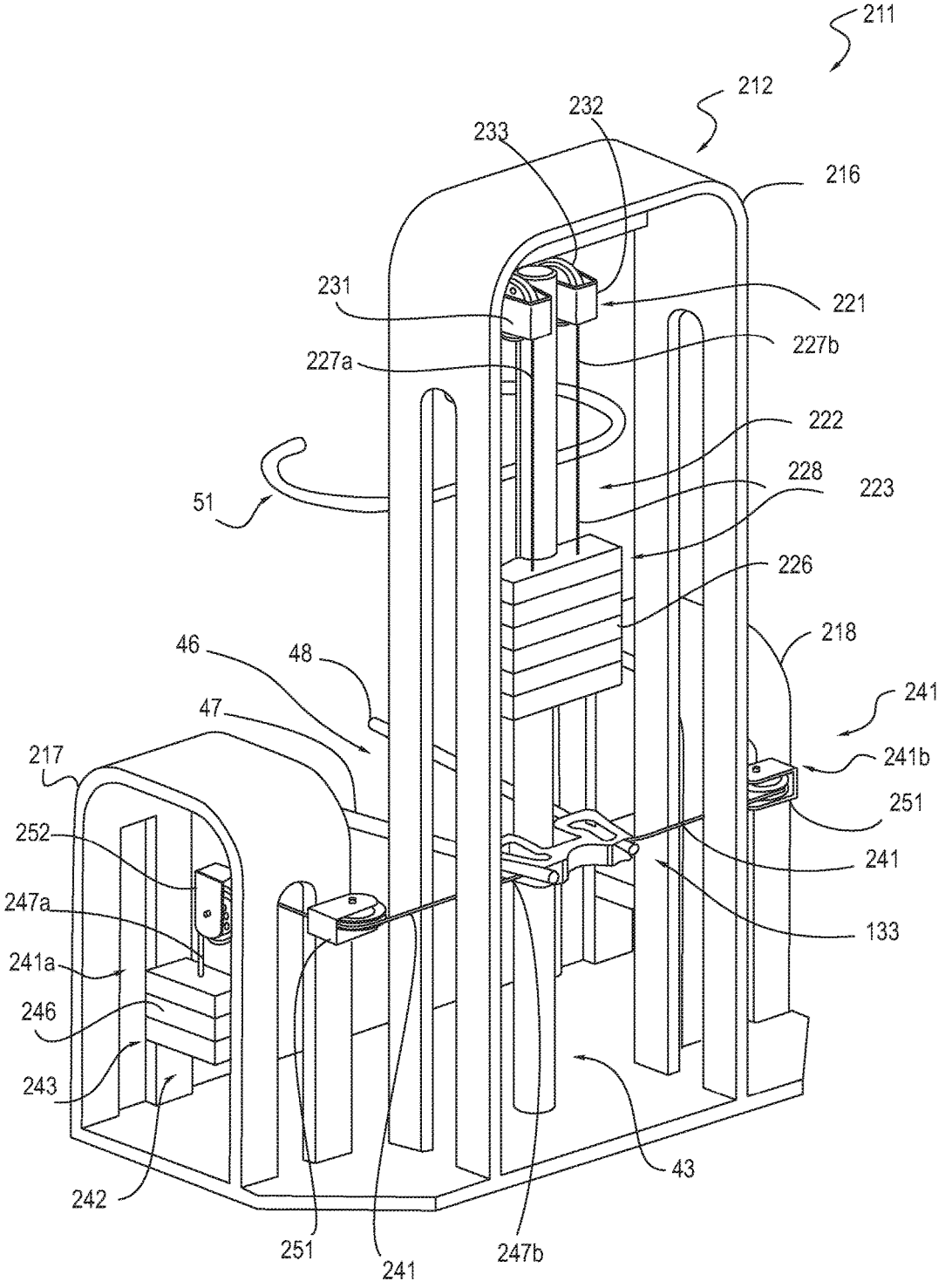
FIG. 23 is a rear perspective view of the exercise apparatus of FIG. 22.

Other embodiments of the apparatus of the invention can be provided. For example, an apparatus 211 substantially similar to apparatus 41 is illustrated in FIGS. 22-23. Like reference numerals have been used to describe like components of apparatus 211 and apparatus 41. The apparatus 211 includes a support structure 212 which can include vertical support 43 secured to a suitable base 213. Arm assembly 46 is carried by vertical support 43, in substantially the same manner as discussed above with respect to apparatus 41, and can include any suitable first and second arms such as left arm 47 and right arm 48. The arm assembly 46 is coupled to vertical support 43 by means of coupling assembly 133. An optional upper body support element 51 can be carried by the vertical support 43. Support structure 212 can further include a central housing 216, a left housing 217 and a right housing 218, all of which can be mounted on base 213. For simplicity, certain optional components of apparatus 211 are not included, for example assembly 171 for urging arm assembly 46 towards its first or upper position and grips or connects 186 provided on second end portion 132 of each of arms 47, 48.

An assembly 221 can be provided and carried by support structure 42, for example by vertical support 43, for inhibiting or resisting movement of the upper body support element 51 as the support element is moved downwardly along vertical support 43 by the user during operation of apparatus 211. The assembly 221 can be of any suitable type and in one embodiment includes a force-exerting device or element 222 for resisting such movement of the upper body support element 51. The force-exerting device or element can be of any suitable type, for example a gas spring, a spring, weights or any combination the foregoing. In one embodiment, the force-exerting device includes an adjustable weight assembly or stack 223 of any suitable type. In one embodiment, the adjustable weight assembly or stack 223 includes a plurality of distinct weights 226 coupled to at least one cable 227 of assembly 221 that is coupled at its other end to upper body support element 51. The at least one cable 227 can include first and second cables 227*a*, 227*b* each having a first end 228 coupled to the distinct weights 226 and a second end 229 coupled to the upper body support element 51. At least one and as shown first and second pulleys 231, 232 can be included in assembly 221 and secured to the top end portion 43*a* of vertical support 43. Each of the pulleys 231, 232 has a respective pulley wheel 233 for receiving the respective cable 227*a*, 227*b*. The first end 228 of each cable 227*a*, 227*b* can be selectively secured to one or more of distinct weights 226 to adjust the amount of force experienced by the user when pulling downwardly on upper body support element 51.

A means, mechanism or assembly 241 can be included in apparatus 211 for each of left arm 47 and right arm 48 for urging the arm towards its first or contracted position. In this regard, a first or left assembly 241*a* can be carried by left housing 217 and coupled to right arm 48 and a second or right assembly 241*b* can be carried by right housing 218 and coupled to left arm 47. Each such assembly 241*a*, 241*b* can be of any suitable type and in one embodiment includes a force-exerting device or element 242 for resisting such movement of the respective arm 48, 47 as the arm is moved from its contracted position to its extended position away from the other arm. The force-exerting device or element can be of any suitable type, for example a gas spring, a spring, weights or any combination the foregoing. In one embodiment, the force-exerting device includes an adjustable weight assembly or weight stack 243 of any suitable type. In one embodiment, the adjustable weight assembly or weight stack 243 includes a plurality of distinct weights 246 coupled to at least one cable 247 of the assembly 241. First end 247*a* of the cable 247 is coupled to the weights 246 and second end 247*b* of the cable is coupled to first end portion 131 the respective arm 47, 48, for example distal of pivot pin 162. At least one and as shown first and second pulleys 251, 252 are provided and carried by the respective housing 217, 218 for directing the travel of the respective cable 247 from the respective arm 47, 48 to the respective adjustable weight stack 243. Left assembly 241*a* is disposed opposite right arm 48 and cable 247 of the left assembly 241*a* extends past first end portion 131 of left arm 47 through coupling assembly 133 so as to engage and connect to right arm 48. Similarly, right assembly 241*b* is disposed opposite left arm 47 and cable 247 of the right assembly 241*b* extends past first end portion 131 of right arm 48 through coupling 133 so as to engage and connect to left arm 47. The first end 247*a* of the cable 247 of each assembly 241*a*, 241*b* can be selectively secured to one or more of distinct weights 246 to adjust the amount of force experienced by the user when pivoting out the respective arm 47, 48.

In operation and use, apparatus 211 can be utilized by the user in substantially the same manner as discussed above with respect to apparatus 41 for exercising various muscles of the user's body. Adjustable weights stack 223 permits the user to easily adjust the amount of weight experienced by the user when pulling or pushing downwardly on upper body support element 51. Similarly, the adjustable weight stack 243 of each of left assembly 241*a* and right assembly 241*b* permit the user to selectively adjust the amount of sideward force exerted by each of right arm 48 and left arm 47 on the respective leg of the user during an exercise regime.

Yet other embodiments of the apparatus of the invention can be provided, for example an apparatus 261 having similarities to apparatus 41 is illustrated in FIGS. 24-28. Like reference numerals have been used to describe like components of apparatus 261 and apparatus 41. The apparatus 261 includes a support structure 262 which can include a vertical support 263 secured to a suitable base 264. Vertical support 263 can be substantially similar to vertical support 43 but shorter in height. The vertical support 263 has a top end portion 263*a* and a bottom end portion 263*b*. Arm assembly 46 is carried by vertical support 263, for example bottom end portion 263*b* of the vertical support 263, in substantially the same manner as discussed above with respect to apparatus 41. Arm assembly 46 can include any suitable first and second arms such as left arm 47 and right arm 48. The arm assembly 46 is coupled to vertical support 263 by means of coupling assembly 133. An optional upper body support element 51 can be carried by vertical support 263, and in apparatus 261 the upper body support element 51 is non-slidably mounted to the top end portion 263*a* of the vertical support 263. Assembly 171 can be included in apparatus 261 for urging arm assembly 26 towards its first or upper position. For simplicity, certain components of apparatus 261 are not included, for example grips or connects 186 provided on second end portion 132 of each of arms 47, 48.

Figure 24:
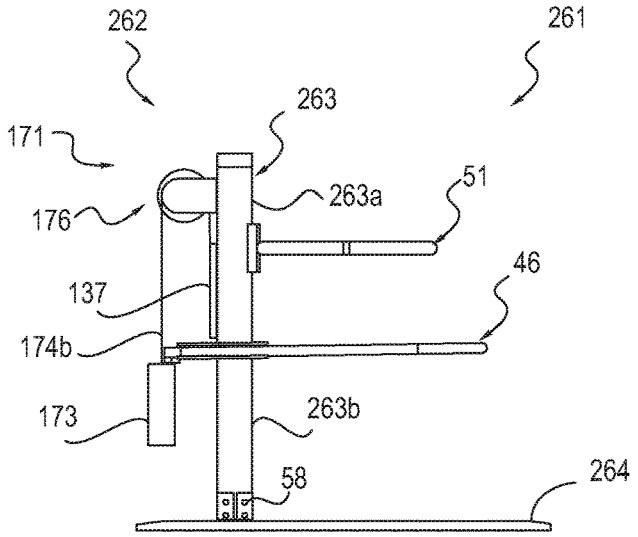
FIG. 24 is a side elevational view of a further embodiment of the exercise apparatus of the invention in a first position.
Figure 25:
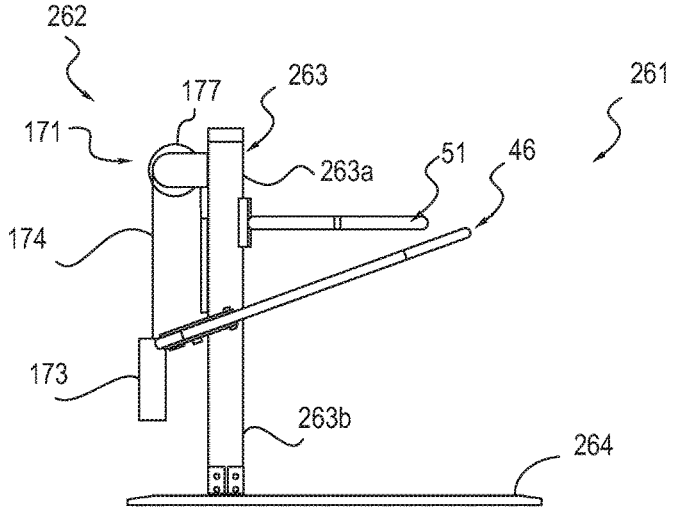
FIG. 25 is a side elevational view of the exercise apparatus of FIG. 24 in a first operational position.
Figure 26:
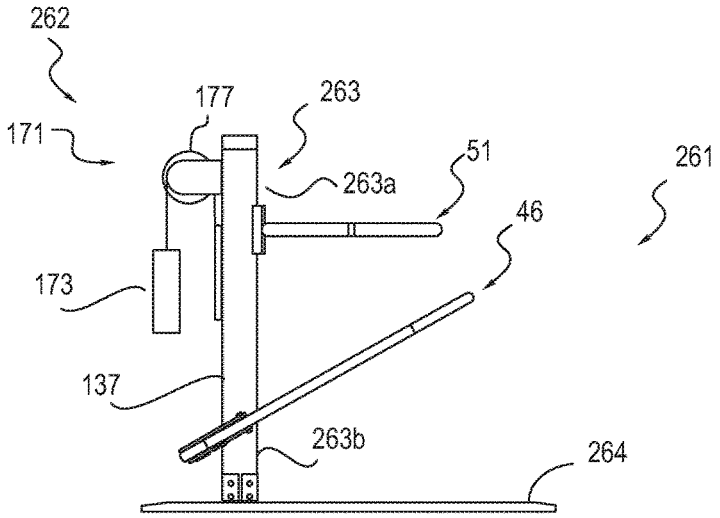
FIG. 26 is a side elevational view of the exercise apparatus of FIG. 24 in a second operational position.
Figure 28:
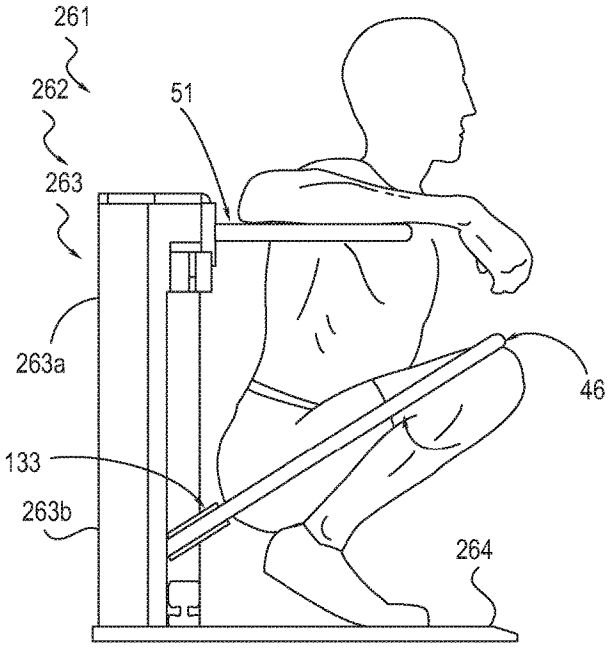
FIG. 28 is a schematic side elevational view of a user in an operational position with the exercise apparatus of FIG. 24.
Figure 27:
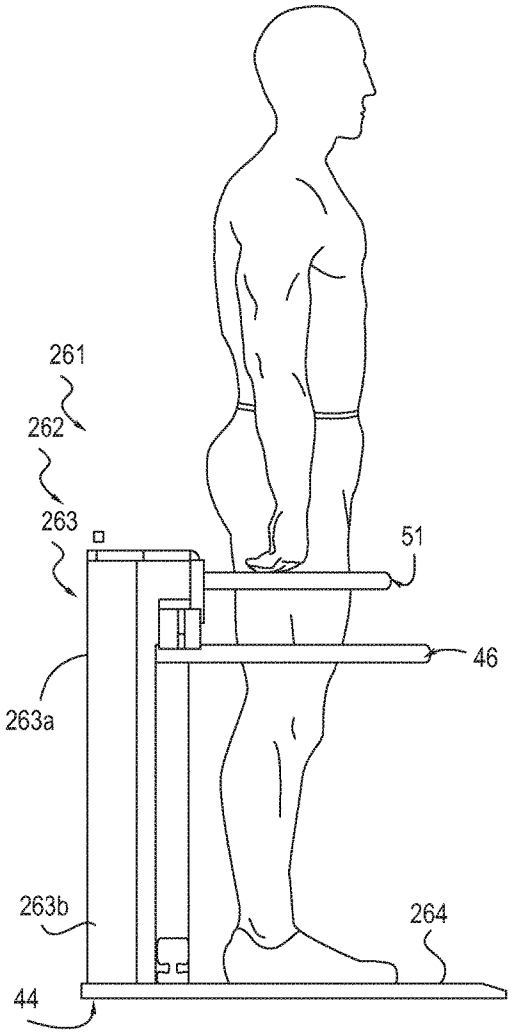
FIG. 27 is a schematic side elevational view of a user in a start position with the exercise apparatus of FIG. 24.

Arm assembly 46 of apparatus 261 is shown in a variety of positions relative to vertical support 263 in FIGS. 24-26. In FIG. 24, the arm assembly 46 is shown in a first or upper position relative to vertical support 263 and in a first or horizontal position relative to the vertical support 263. In FIG. 25, arm assembly 46 is shown in a second or inclined position, that is inclined relative to the first or horizontal position of FIG. 24. In FIG. 26, arm assembly 46 is shown in a second or lower position relative to vertical support 263 and in yet a further inclined position, that is at a greater inclination relative to the horizontal position in FIG. 24 when compared to the inclined position of FIG. 25.

In the operation and use of apparatus 261, the user can engage his or her knees with respective arms 47, 48 of arm assembly 46 and pivot the knees outwardly relative to each other in the same manner as discussed above with respect to apparatus 41. The user can squat to any position to so pivot his or her knees, or pivot the knees continuously from the user's vertical position shown in FIG. 27 to the user's deep squat position shown in FIG. 28. As such, the gluteus maximus muscles of the user can be exercised at a variety of different angles and inclinations. Upper body support element 51 can serve to stabilize the user while squatting during the exercise regime.

Apparatus 261 is relatively compact when compared to apparatus 41 and apparatus 211. The apparatus 261 can be reconfigured to a more compact condition, for example to facilitate transfer or storage of the apparatus 261. In this regard, for example, upper body support element 51 can be pivotably secured to vertical support 263 so as to pivot downwardly, for example through an angle of 90 degrees, so as to extend substantially parallel to and be substantially flush with the vertical support 263. Similarly, arm assembly 46 can be configured to pivot to a substantially flush position with vertical support 263. In this regard, for example, coupling assembly 133 can be configured to permit arm assembly 46 to pivot upwardly so as to be substantially parallel to the vertical support 263. Base 264 can additionally be configured to be either removed from the vertical support 263 or pivoted to a more compact position for facilitating transfer or storage of the apparatus 261.

In one embodiment, an exercise apparatus for use by a human having first and second legs is provided and can include a vertical support, an arm assembly having first and second arms for respectively engaging the outside of the first and second legs of the human, a coupling assembly for securing the arm assembly to the vertical support, the coupling assembly including a slide assembly for permitting the arm assembly to move vertically on the support element between an upper position and a lower position so as to facilitate alignment of the first and second arms with the first and second legs of the human as the human moves downwardly relative to the vertical support to a squat position and a pivot assembly for permitting the first and second arms to move between a contracted position when the first and second legs are extending alongside each other and an extended position when the first and second legs are pivoted away from each other, and means for urging the first and second arms towards the contracted position whereby the gluteus maximus muscles of the human are exercised when the first and second legs of the human are pivoted away from each other against the force of the first and second arms.

The exercise apparatus can include an upper body support element for engagement by the first and second arms of the human and an assembly carried by the vertical support for securing the upper body support element to the vertical support whereby the upper body support element provides support to the human as the human moves downwardly relative to the vertical support to the squat position. The assembly can include a slide assembly for permitting the upper body support element to move vertically on the vertical support from an upper position when the human is in a standing position and a lower position when the human is in a squat position whereby the upper body support element provides support as the human moves between the standing position and the squat position. The upper body support element can have a first outwardly-extending arm for engagement by the first arm of the human and a second outwardly-extending arm for engagement by the second arm of the human. The device can be free of a seat for permitting the human to sit while the first and second arms move between the contracted position and the extended position. The coupling assembly can include an additional pivot assembly for permitting the first and second arms to pivot between a horizontal position and an inclined position relative to the vertical support independent of the first and second arms moving between the contracted position and the extended position.

In one embodiment, an exercise apparatus for use by a human having first and second legs is provided and can include a vertical support, an arm assembly having first and second arms for respectively engaging the outside of the first and second legs of the human, a coupling assembly for securing the arm assembly to the vertical support, the coupling assembly including a first pivot assembly for permitting the first and second arms to move between a contracted position when the first and second legs are extending alongside each other and an extended position when the first and second legs are pivoted away from each other and a second pivot assembly for permitting the first and second arms to pivot between a horizontal position and an inclined position relative to the vertical support independent of the first and second arms moving between the contracted position and the extended position, and means for urging the first and second arms towards the contracted position whereby the gluteus maximus muscles of the human are exercised when the first and second legs of the human are pivoted away from each other against the force of the first and second arms.

The exercise apparatus can include an upper body support element adapted for engagement by the first and second arms of the human and an assembly carried by the vertical support for securing the upper body support element to the vertical support whereby the upper body support element provides support to the human as the human moves downwardly relative to the vertical support to the squat position. The assembly can include a slide assembly for permitting the upper body support element to move vertically on the vertical support from an upper position when the human is in a standing position and a lower position when the human is in a squat position whereby the upper body support element provides support as the human moves between the standing position and the squat position. The exercise apparatus can be free of a seat for permitting the human to sit while the first and second arms move between the contracted position and the extended position.

In one embodiment, an exercise apparatus for use by a human having an upper body and first and second legs is provided and can include a vertical support, an upper body support element adapted for engagement by the upper body of the human, a slide assembly carried by the vertical support and secured to the upper body support element for permitting the upper body support element to move vertically on the vertical support from an upper position when the human is in a standing position and a lower position when the human is in a squat position whereby the upper body support element provides support to the human when moving between the standing position to the squat position, an arm assembly having first and second arms for respectively engaging the outside of the first and second legs of the human, a coupling assembly for securing the arm assembly to the vertical support and including a pivot assembly for permitting the first and second arms to move between a contracted position when the first and second legs are extending alongside each other and an extended position when the first and second legs are pivoted away from each other, and means for urging the first and second arms towards the contracted position whereby the gluteus maximus muscles of the human are exercised when the first and second legs of the human are pivoted away from each other against the force of the first and second arms.

The upper body support element can be configured for engagement by the first and second arms of the human. The upper body support element can have a first arm for engagement by the first arm of the human and a second arm for engagement by the second arm of the human. Each of the first and second arms of the upper body support element can arc sidewardly and forwardly of the vertical support for extending under the respective outstretched first and second arms of the human. The coupling assembly can include an additional slide assembly for permitting the arm assembly to move vertically on the support element between an upper position and a lower position. The exercise apparatus can include a force-exerting device coupled to the arm assembly for urging the arm assembly towards the upper position. The force-exerting device can include a weight. The coupling assembly can include an additional pivot assembly for permitting the first and second arms to pivot relative to the vertical support between a horizontal position and an inclined position independent of the first and second arms moving between the contracted position and the extended position. The coupling assembly can include an additional slide assembly for permitting the arm assembly to move vertically on the support element between an upper position and a lower position and an additional pivot assembly for permitting the first and second arms to pivot relative to the support element between a horizontal position and an inclined position independent of the arm assembly moving between the upper position and the lower position. The exercise apparatus can include a base, wherein the vertical support is secured to the base and extends upwardly from the base. The exercise apparatus can include a force-exerting device coupled to the upper body support element for inhibiting movement of the upper body support element under the force of the human from the upper position to the lower position. The force-exerting device can include a gas spring. The force-exerting device can include an adjustable weight assembly. The means for urging the first and second arms towards the contracted position can include a first spring coupled to the first arm and a second spring coupled to the second arm. The means for urging the first and second arms towards the contracted position can include an adjustable weight assembly.

As can be seen from the foregoing, an apparatus has been provided for working the gluteus maximus muscles of the human, which muscles are specifically related to a human's vertical posture and locomotion. Use of the apparatus can add torque to the hip joint of a user. The apparatus can strengthen the "seat" of a user, which can have a positive effect on the prevention of urinary, bladder and fecal incontinence. The apparatus can be configured to support a user's body during deep squat exercises. The apparatus advantageously utilizes internal and external rotation instead of abduction and abduction. The apparatus advantageously uses the gluteus maximus muscles as a prime mover instead of a stabilizer. The apparatus advantageously works muscles that secure the low back and stabilize the hips and knees for locomotion. The apparatus advantageously protects and accentuates the body's structural curves. The apparatus advantageously assists a user doing "primal squats." The muscles being worked. The user can change from flat footed to dorsi flexion (heels down toes up) and onto the balls of his or her feet (heels up) thereby using telescoping forces applied thru plantar flexion to return to vertical posture with heels down. The apparatus can support the user's body weight while the user moves down into a deep "primal squat" posture. The user can simultaneously engage his or her gluteus maximus muscles by rolling outwardly at the knees. The apparatus can assist the user while moving back up into a vertical posture. The apparatus can be a useful tool with many applications, for example in gyms, in homes and in physical therapy and rehabilitation settings.

As evident from the above description, a wide variety of embodiments may be configured from the description given herein and additional advantages and modifications will readily occur to those skilled in the art. The invention in its broader aspects is, therefore, not limited to the specific details and illustrative examples shown and described. Accordingly, departures from such details may be made without departing from the spirit or scope of the applicant's general invention.

What is claimed is:

1. An exercise apparatus for use by a human having first and second legs, comprising a base, an arm assembly having first and second arms for respectively engaging the outside of the first and second legs of the human, a coupling assembly for securing the arm assembly to the base, the coupling assembly including a first pivot assembly for permitting the first and second arms to move between a contracted position when the first and second legs are extending alongside each other and an extended position when the first and second legs are pivoted away from each other and a second pivot assembly for permitting the first and second arms to pivot between a first position and a second inclined position relative to the base independent of the first and second arms moving between the contracted position and the extended position, and a force-exerting device for urging the first and second arms towards the contracted position whereby gluteus maximus muscles of the human are exercised when the first and second legs of the human are pivoted away from each other against the force of the first and second arms.

2. The exercise apparatus of claim 1, wherein the force-exerting device includes a spring.

3. The exercise apparatus of claim 2, wherein the force-exerting device includes a first spring coupled to the first arm and a second spring coupled to the second arm.

4. The exercise apparatus of claim 1, wherein the coupling assembly is secured to the base by means of a support element.

5. The exercise apparatus of claim 4, wherein the support element includes a post.

* * * * *